United States Patent [19]

Leonard

[11] 4,283,990

[45] Aug. 18, 1981

[54] FLUIDIC REPEATER

[76] Inventor: Willie B. Leonard, 5902 Royalton, Houston, Tex. 77036

[21] Appl. No.: 62,964

[22] Filed: Aug. 2, 1979

Related U.S. Application Data

[60] Division of Ser. No. 872,826, Jan. 27, 1978, which is a division of Ser. No. 622,760, Oct. 15, 1975, Pat. No. 4,094,229, and a continuation-in-part of Ser. No. 521,036, Nov. 5, 1974, Pat. No. 4,046,059, which is a continuation-in-part of Ser. No. 489,829, Jul. 18, 1974, Pat. No. 3,988,966.

[51] Int. Cl.[3] ..... F15B 15/22; F01B 13/04

[52] U.S. Cl. ..... 91/47; 91/51; 91/396

[58] Field of Search ..... 91/388, 51, 47, 396

[56] References Cited

U.S. PATENT DOCUMENTS

| | | | |
|---|---|---|---|
| 2,973,746 | 3/1961 | Jupa | 91/51 |
| 2,989,950 | 6/1961 | Lockman | 91/388 |
| 3,083,695 | 4/1963 | Stiglic | 91/51 |
| 3,486,416 | 12/1969 | Eastman | 91/47 |

FOREIGN PATENT DOCUMENTS

| | | | |
|---|---|---|---|
| 2223995 | 12/1973 | Fed. Rep. of Germany | 91/388 |
| 1142014 | 2/1969 | United Kingdom | 91/388 |

*Primary Examiner*—Paul E. Maslousky

*Attorney, Agent, or Firm*—Murray Robinson; Ned L. Conley; David Alan Rose

[57] ABSTRACT

Two fluid passages are connected through flow restrictors to a fluid supply. Downstream of the restrictors the fluid supply has a drooping pressure-load characteristic. Venting means for the fluid passages comprises vent openings therein downstream of the restrictors and variable position obstructor means cooperating with vent openings to vary venting and thereby vary fluid pressures in the fluid passages.

Fluid conduits connect these pressure outputs to a fluid to mechanical translator comprising a double acting piston moving in a cylinder whose opposite ends are connected to the fluid conduits.

A receiver is formed by a piston and cylinder or other fluidic motor remotely fluidically connected to the responder, the motor driving a load. Alternatively the remote motor may be omitted, the responder itself constituting a receiver and its piston connected, mechanically or fluidically, to an output display or load for indication or proportional control.

A feedback means controlled by the position of the responder piston and/or the load varies pressure in the fluid conduits by variably venting same. The degree of feedback venting is a function of piston movement. The venting path of the feedback means is in parallel with the venting path of the transmitter.

Instead of variable venting, variable pressures can be generated by making the restrictors variable and conducting downstream pressure by two lines to the responder. Furthermore, the transmitter may be modified to effect change in only one pressure. A single line may then be used between transmitter and responder.

Both rotary and linear types of transmitters and load feedback means and receivers may be used.

2 Claims, 51 Drawing Figures

Fig. 23
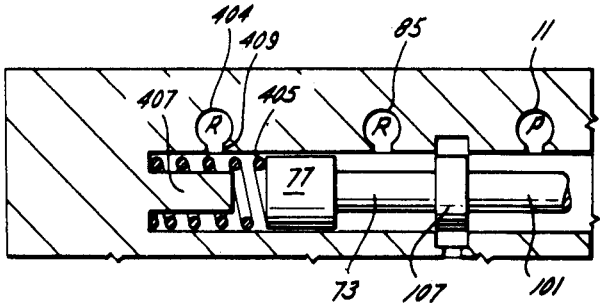
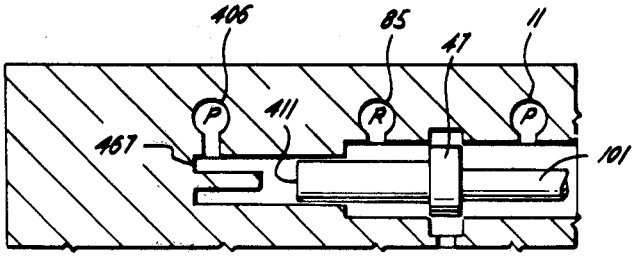
Fig. 24
Fig. 25
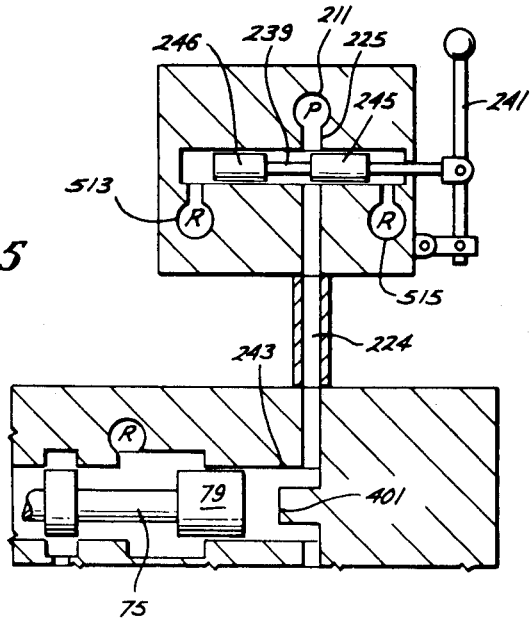

27
27
600
602
604
606
608
610
612
614
618
620
622
624
626
628
630
632
634
636
638
640
642
643
644
646
648
650
652
654
656

31
31
641
654
642
644
648
646
640
656
636
632
724
706
722
720
704
726
728
736
702
732
734
730
718
716
714
703
708
716
706'
701
710
707
712
706'
714
705
700
31
706'
712
710
711
707
708
701
31
706'
709
711
713
714
716

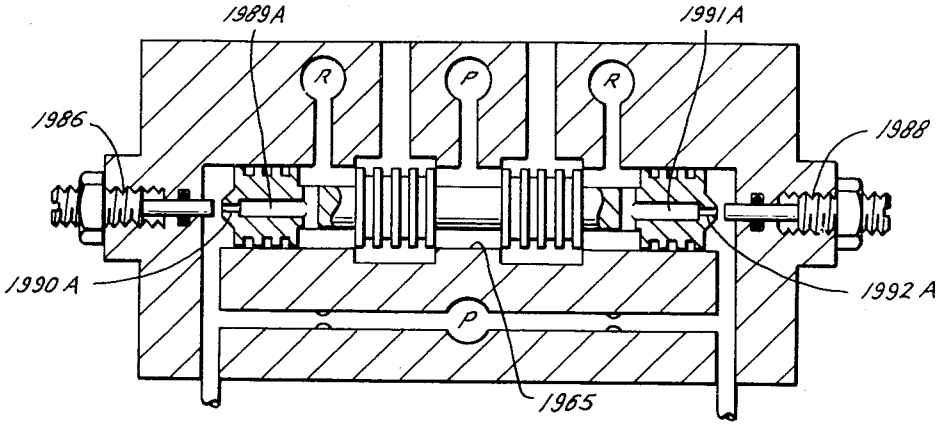
Fig. 47
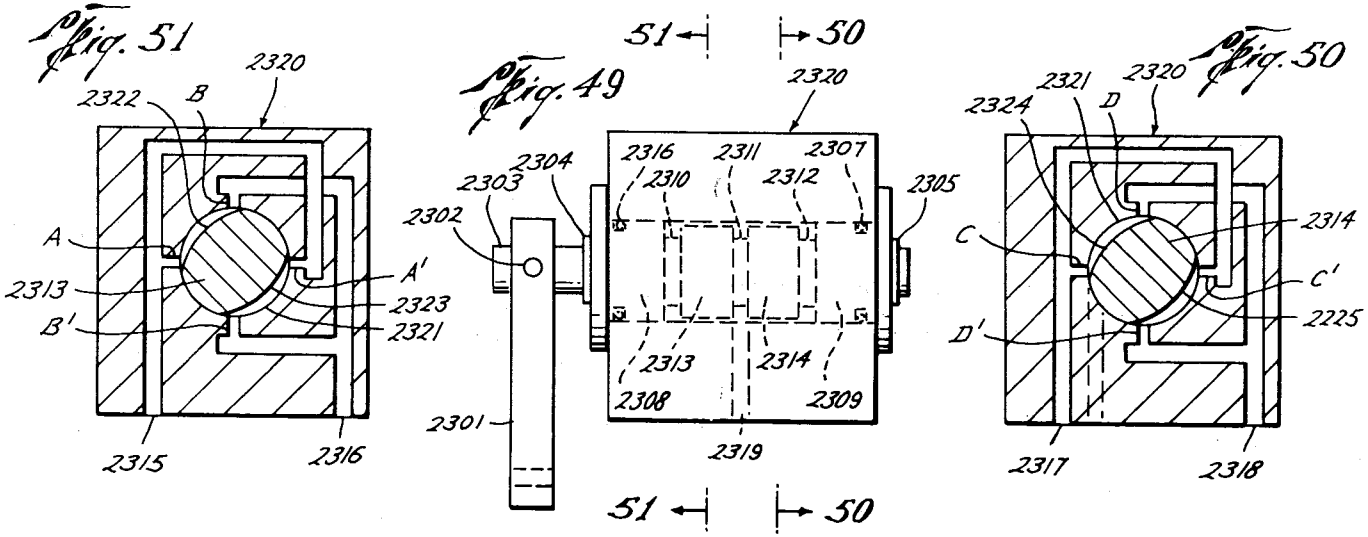
Fig. 50
Fig. 49
Fig. 51

FLUIDIC REPEATER

CROSS REFERENCE TO RELATED APPLICATIONS

The present application is a division of applicant's prior application Ser. No. 872,826, filed Jan. 27, 1978; Ser. No. 872,826 was a division of application Ser. No. 622,760 filed Oct. 15, 1975, now U.S. Pat. No. 4,094,229, issued June 13, 1978; Ser. No. 622,760 was a continuation-in-part of application Ser. No. 521,036, filed Nov. 5, 1974, now U.S. Pat. No. 4,046,059, issued Sept. 6, 1977; Ser. No. 521,036 was a continuation-in-part of application Ser. No. 489,829, filed July 18, 1974, now U.S. Pat. No. 3,988,966, which issued Nov. 2, 1976.

BACKGROUND OF THE INVENTION

This invention pertains to fluidic, e.g. hydraulic or pneumatic, repeaters useful as remote indicators and servo proportional controllers for either amplication or remote operation, e.g. in seismic generators, aircraft controls, boat steering, automobile wheel tracking, plow jerkers, and vibration test equipment.

Hydraulic devices employing mechano-hydraulic transmitters including an obstructor moving relative to two liquid ports connected to a liquid supply having a drooping pressure-load characteristic are known. It is also known to employ as a receiver or responder a double acting piston moving in a cylinder whose ends are connected by fluid conduits to the transmitter liquid supply upstream of the transmitter ports and to connect the piston mechanically or hydraulically to an output. Various feedbacks from the output to the transmitter are also known.

SUMMARY OF THE INVENTION

According to the invention, means for feedback control, whether incorporated directly in the double acting piston or mechanically connected thereto, comprises variable cross-section surface passages, e.g. tapered grooves. These grooves may be in the ends of a double acting piston cooperating with ports or side recesses of a cylinder. The piston moves to variably throttle fluid vented from the high pressure ends of the piston ends of the piston to lower pressure portions of the system. The invention further includes improved transmitter, responder and receiver means useful with the feedback means of the invention, e.g. systems in which the transmitter has a single line output for actuating the responder or receiver, systems in which the transmitter operates by variable throttling, and systems employing rotary type transmitters and systems with rotary type feedback means. Other features of the invention and objects and advantages thereof will appear hereinafter.

The feedback venting and the transmitter venting flow passages are in parallel so that the rate of venting effected by the feedback means is dependent solely on the position of the feedback means.

Various applications of the invention, e.g. to crane control, seismic generator drive, swash plate angle control of a swash plate controlled motor-pump unit, four wheel drive, and master and slave systems are disclosed.

BRIEF DESCRIPTION OF THE DRAWINGS

For a more detailed description of several preferred embodiments of the invention reference will now be made to the accompanying drawings wherein:

FIG. 23 is a fragmentary schematic sectional view of a portion of an embodiment of the invention;

FIG. 24 is a view similar to FIG. 23 showing a portion of another embodiment;

FIG. 25 is a fragmentary, largely schematic sectional view showing a portion of an embodiment of the invention;

FIG. 47 is a sectional of an amplifier forming part of a system according to the invention;

FIG. 49 is an elevation showing a dual rotary transmitter in accordance with the invention; and FIGS. 50, 51 are sections taken on planes 50—50 and 51—51 of FIG. 49.

DESCRIPTION OF PREFERRED EMBODIMENTS

Figure 1:
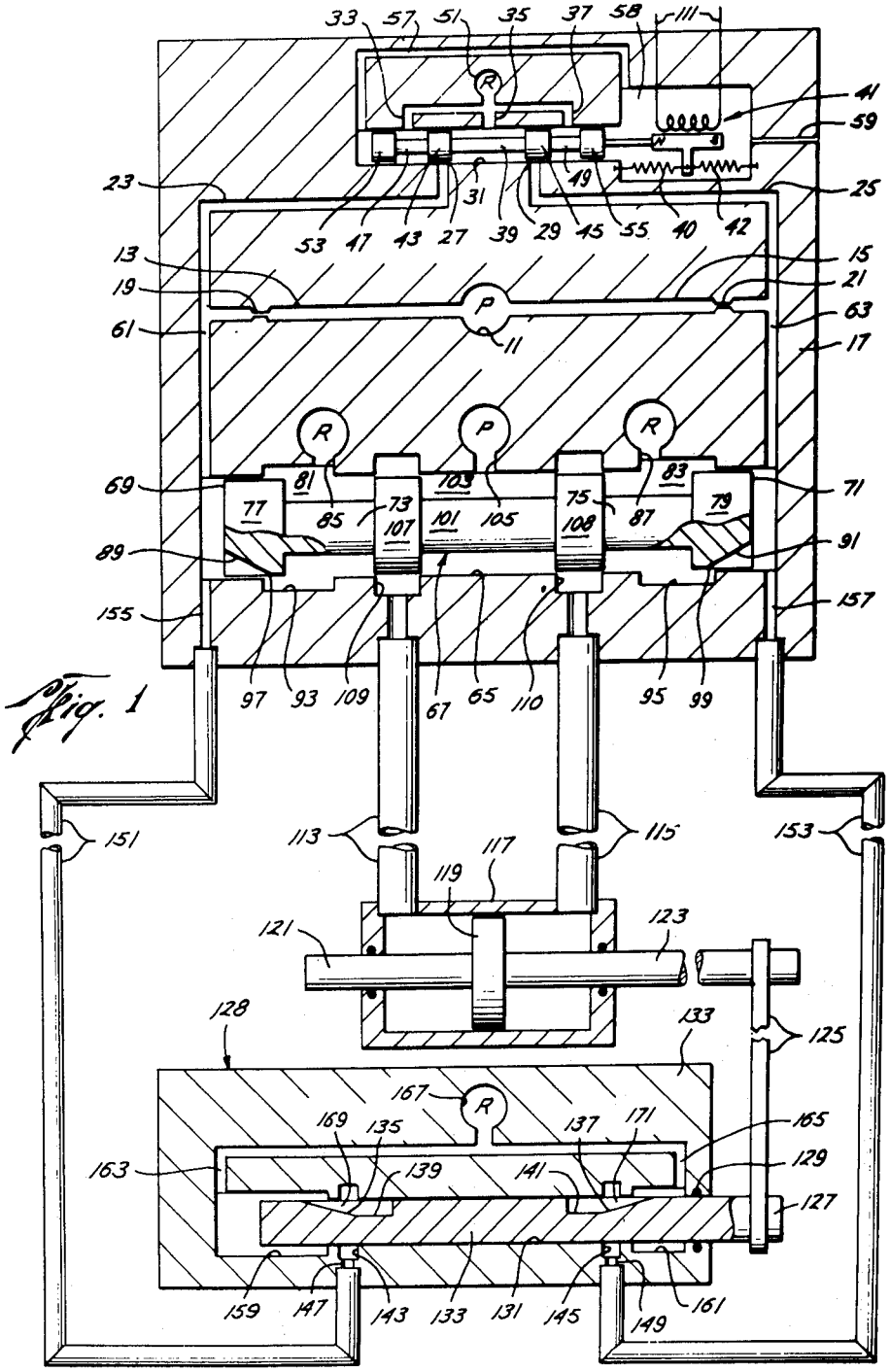
FIG. 1 is a largely schematic sectional view illustrating a fluidic repeater according to the referred embodiment of the invention.

Referring now to FIG. 1, a fluidic repeater comprises a pump or source (not shown) of fluid under pressure connected to conduits marked P and a sump or low pressure fluid reservoir (not shown) connected to conduits marked R. Usually the system will be hydraulic and use a liquid, e.g. mineral oil, as working fluid, but the following description refers to all embodiments of the invention and is also applicable to pneumatic systems wherein a gas, e.g. air, is the system fluid.

Fluid from pressure source conduit 11 flows through passages 13, 15 in transmitter body 17, through restrictions or orifices 19, 21 to passages 23, 25, and thence out through ports 27, 29. The ports empty into the interior of cylinder 31 formed in transmitter body 17. Cylinder 31 is vented to reservoir 51 by three ports 33, 35, and 37. A four landed spool 39 is moved axially back and forth in cylinder 31 by electromagnetic solenoid 41, which may also be a short stroke torque motor. The solenoid is biased to its midposition, as shown, by springs 40 and 42. When spool 39 is biased to mid position, as shown in FIG. 1, lands 43 and 45 fully or substantially block ports 27 and 29. This reduces the transmitter's idle power requirements. In a modulating system both ports will be partially open in the mid-position of the spool.

Operationally, electric signals applied to solenoid or electric motor 41 moves spool 39 toward one end of cylinder 31. This opens either port 27 or 29 an amount whose magnitude is dependent upon the spool's movement. In a modulating system, the port not opened will be closed an amount also dependent upon the spool's axial movement. As one port is opened, e.g. port 27, pressure in passage 23 drops due to the increased fluid flow from the source through the flow restrictor or orifice 19, while closure of the other port, e.g. port 29, will cause a pressure rise in passage 25 due to the reduced flow through orifice 21. Flow passage 13 with orifice 19 and the flow passage 15 with orifice 21 thus provide fluid supplies of drooping pressure-load characteristics. Connected to this supply are ports 27, 29, and spool 39 with lands 43, 45. These provide a variable obstructor for opening and closing the ports this variably venting the fluid supplies to provide variable pressure outputs that vary in accordance with the obstructor's position. Since obstructor position is controlled by an electric motor, the system thus far detailed provides an electrofluidic transducer transmitter.

To prevent hydraulic locking of spool 39 because of the inherent slight leakage past lands 43 and 45, the spools are relieved by providing annular spaces 47 and 49 beyond lands 43 and 45 that communicate with ports 33 and 37. These ports lead to conduit 51 that is connected to reservoir 51. Spool 39 is provided with additional guidance by providing it with each lands 53 and 55. The ends of cylinder 31 are connected by fluid passage 57 that leads to chamber 58. Chamber 58 contains motor 51 and is vented to the atmosphere by passage 59.

The transmitter's varying fluid pressure outputs are conducted by fluid passages 61 and 63 to an amplifier comprising cylinder 65 formed in transmitter body 17. A double acting free piston 67 floats in cylinder 65, being free to move axially in response to pressure differentials at its ends 69, 71. Fluid passages 61, 63 from the transmitter are connected to the ends of cylinder 65 so their pressures can act on the free piston's end. The outer periphery of the piston is relieved by annular grooves 73 and 75, leaving lands 77 and 79 at the ends of the piston. Annular spaces 81 and 83 formed by grooves 73 and 75 are vented to the reservoir by fluid passages 85, 87. Lands 77 and 79 are provided with sloping grooves 89 and 91, respectively, whose depth decreases progressing from the ends of the piston toward grooves 73 and 75. Sloping grooves 89 and 91 vent pressure fluid from passages 61 and 63 past lands 77 and 79 to recesses 93 and 95 in the cylinder' sides and hence to the reservoir through passages 85 and 87. Suitable means, not shown, such as a key and slot, are provided to maintain grooves 89 and 91 in azimuthal alignment with recesses 93 and 95. The size of vent openings 97 and 99 connecting grooves 89 and 91 with recesses 93 and 95 increase and decrease when piston 67 is moved axially. This venting causes negative feedback to fluid passages 61 and 63. Higher pressure at one of passage 61 or 63 than at the other moves free piston 67 in the correct direction to increasingly vent these higher pressure to a reservoir through either groove 89 or 91. Relatively lower pressure in passage 61 or 33 than in the other moves free piston 67 in a direction to reduce venting of such lower pressure to the reservoir. Due to this variable negative feedback, piston 67 moves proportionally in response to the degree of movement of spool 39 and then comes to rest.

Free piston 67 could be connected mechanically to a suitable output such as an indicator, valve or other load. Cylinder 65 and piston 67 would then constitute parts of a receiver connected to the previously described transmitter. Passages 61 and 63 could be replaced by hoses, pipes, or other extended fluid conduits. The system would then constitute a remote indicating or proportional control system.

As shown in FIG. 1, however, piston 67 and cylinder 65 form parts of a fluidic amplifier. Piston 67 is relieved at its mid portion by annular groove 101. Annular space 103 formed by groove 101 is connected by fluid passage 105 leading to a source of fluid pressure. Lands 107 and 108 between groove 101 and grooves 73 and 75, cover outlet ports 109 and 110 in cylinder 65 when piston 69 is in mid position, as shown. When piston 69 moves axially toward one end of cylinder 65 in response to electric signals supplied to conductors 111 of motor 41, then ports 107 and 109 are uncovered in proportion to the piston's movement. One fluid conduit (hoses) 113 or 115 is thus connected to a source of pressure fluid through space 103 and passage 105 while the other of conduits is connected to reservoir through either space 81 and passage 85 or space 83 and passage 87. Hoses 113 and 115 are connected to opposite ends of load cylinder 117, which, together with piston 119 therein, forms a remote receiver.

When hose 113 or 115 is connected to the source of pressure fluid and the other to the reservoir, piston 119 moves in the direction of the flow from high pressure to low pressure. Piston rods 121, 123 extend through opposite ends of the cylinder 117, leaving equal areas of piston 119 exposed to pressures in cylinder 117. Piston rod 123 is extended to connect to a mechanical load, e.g. a valve, not shown.

Piston rod 123 is also connected mechanically by bar 125 to stem 127 of feedback valve 128. For easier viewing, valve 128 is drawn to a larger scale than load cylinder 117, but it is to be understood that the areas exposed to fluid pressure in the feedback valve are negligibly small compared to those of load cylinder 117.

Stem 127 extends through sealed opening 129 into cylinder cavity 131 of valve body 163 and connects to cylindrical valve elosure 133. Closure 133 is provided with two sloping grooves 135 and 137 of increasing. depth progressing axially from the ends toward the midportion of the closure. The deepest portions of the grooves being continued axially at constant depth for a certain extent as shown at 139 and 141. When the closure 133 is in midposition, as shown in FIG. 1, sloping portions of grooves 135 and 137 are in register axially with annular recesses 143 and 145 in the sides of cylindrical cavity 131. Recesses 143 and 145 communicate with ports 147 and 149, respectively, which, in turn, are connected to fluid conduits (hoses) 151 and 153. Conduits 151 and 153 are connected to ports 155 and 157, respectively, leading to the ends of amplifier cylinder 65.

The ends of cylindrical valve body cavity 131 are enlarged at 159 and 161 providing annular spaces communicating both with grooves 135 and 137 and also with passages 163 and 165 leading to conduit 167 connecting with the reservoir. When closure 133 moves axially, openings 169 and 171 between grooves 135 and 137 and the sides of cylindrical valve body cavity 131 are opened or closed in proportion to the degree of axial movement. This increases the venting to the reservoir of one of the feedback conduits 151 and decreasing the venting of the other.

Operationally, when a pressure differential across the ends of amplifier piston 67 causes the piston to move right or left, then load piston 119 moves in the opposite direction carrying with it attached feedback valve closure 133. This creates a pressure differential between conduits 151 and 153 opposite to that across piston 67. The feedback from cylinder 128 is therefore negative and tends to cancel out the pressure differential caused by movement of spool 39. This cancellation causes piston 67 to return to neutral or midposition. This discontinues the pressure differential across load piston 119, which then comes to rest in a displaced position proportional to the displacement of spool 39 that in turn was proportional to the signal strength applied to motor 41 at input 111.

Although motions of the various parts; e.g. transmitter spool 39, amplifier piston 101, load piston 119, and feedback valve closure 133; have been said to be proportional to the signal applied to the input 111 of motor 41, this is to be understood to mean only that there is a direct function between signal amplitudes and mechanical positions with an increase in signal strength causing an increase in mechanical travel. However, by appropriately shaping grooves 89, 91, 135 and 137, the proportionality may be made to approach closely a linear function. Other groove shapes than the simple sloping grooves 89, 91, 135 and 137 may be employed.

Figure 2:
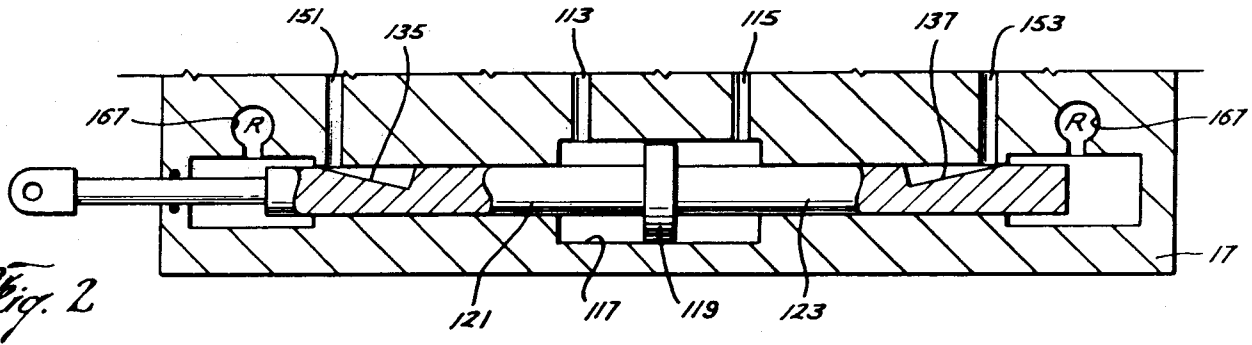
FIGS. 2 and 3 are fragmentary views similar to FIG. 1 showing modifications.
Figure 3:
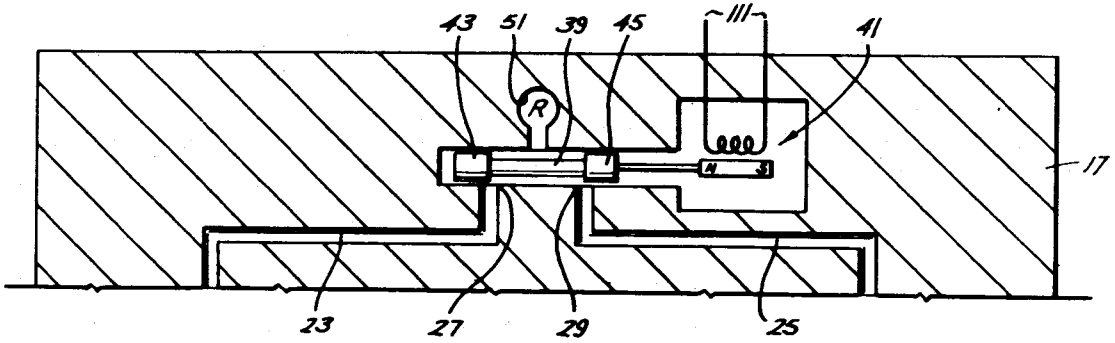

Referring now to FIGS. 2 and 3 there are shown modifications of the FIG. 1 construction. FIGS. 2 and 3 show only a portion of the apparatus shown in FIG. 1; the remainder of FIGS. 2; and 3's apparatus being the same as that of FIGS. 1 and 17. Parts that are the same as those in FIG. 1 are given like reference numbers and their description will not be repeated. An examination of FIGS. 2 and 3 will reveal that in FIG. 2 as in FIG. 1 lands 43 and 45 are disposed so as to substantially block ports 27 and 29 when sool 39 is in midposition; whereas in FIG. 3 lands 43 and 45 are disposed to leave both ports 27 and 29 partly open when spool 39 is in midposition. In other respects FIGS. 2 and 3 are the same.

FIGS. 2 and 3 differ from the FIG. 1 construction in two respects. First, guide lands 53 and 55 are omitted from spool 39, as are leakage return ports 33 and 37 and atmosphere vent passages 57 and 59. These of course can be used wherever it is found necessary or desirable. Secondly, and most important, in FIGS. 2 and 3 separate feedback valve 128 is omitted. Instead feedback valve means comprising grooves 135 and 137 controlling fluid conduits 151 and, respectively, 153 are provided directly on the ends of valve stems 121 and 123.

Figure 4:
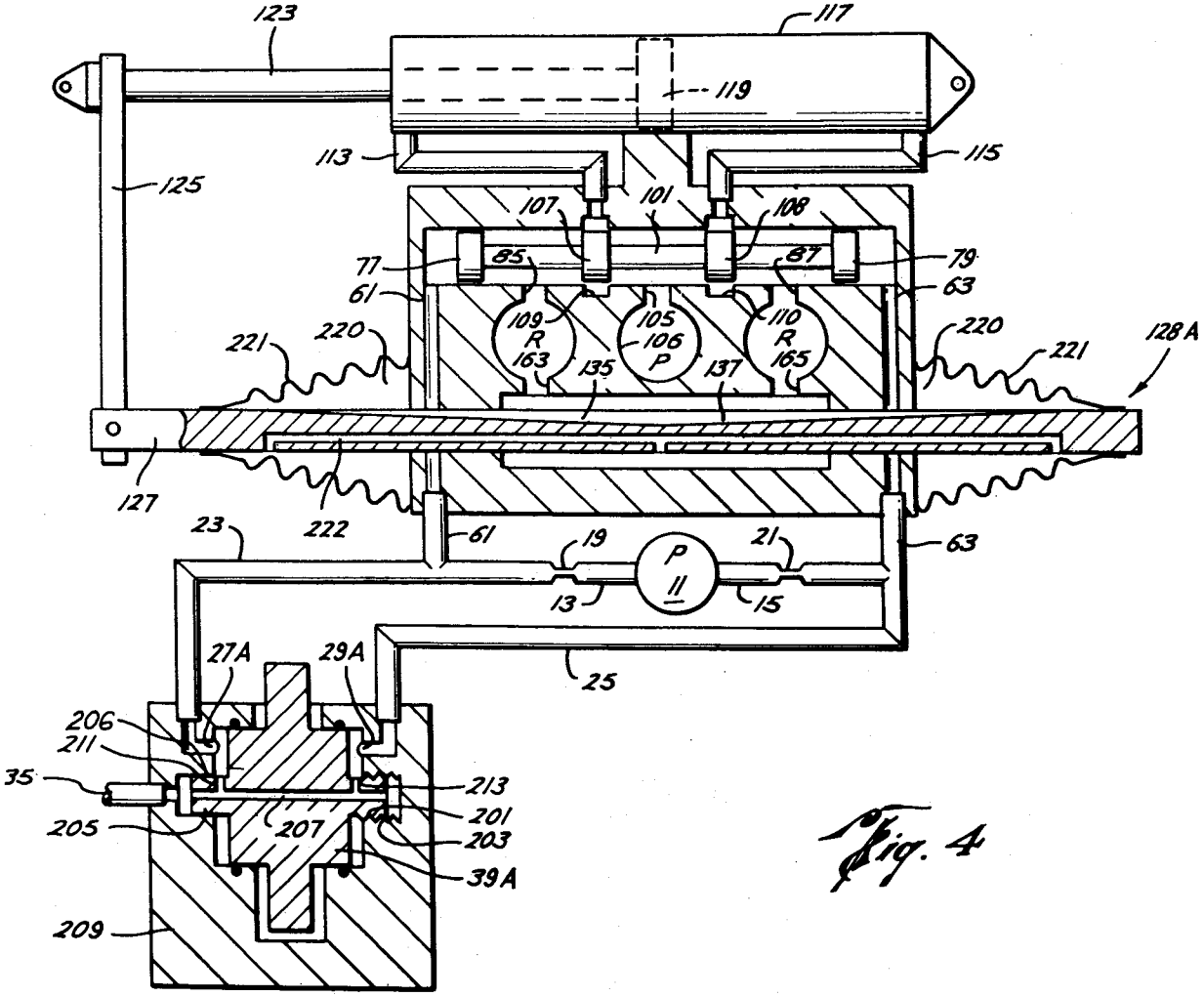
FIGS. 4 and 5 are views similar to FIGS. 1–3 showing two further modifications.

Referring now to FIG. 4 there is shown another modification of the FIG. 1 system. Again like parts are given like reference numbers and will not again be described.

The primary difference between the embodiments of the invention shown in FIGS. 1 and 4 is that in FIG. 4 the spool controlled ports 27 and 29 of FIG. 1 are replaced by nozzles 27A and 29A whose flow is controlled by obstructor 39A. The latter is a hand operated wheel, as distinguished from the electric motor actuated spool 39 of FIG. 1. Bearing 201 at one side of cylindrical obstructor 39A is internally threaded to receive threaded pin 203 on which the obstructor pivots. As the obstructor is rotated it moves axially approaching one or the other of nozzles 27A or 29A and moving farther away from the nozzle not approached. By this means the fluid pressure in conduits 23 and 25 is varied. Obstructor 39A is provided with unthreaded pivot pin 205 received in bearing 207 in obstructor support body 209. Nozzles 27A and 27B discharge into the interior of body 209. Radial passages 211 and 213 in pins 203 and 205, respectively communicate with the interior of body 209 and connect with axial fluid passage 207 which discharges into return line 35 leading to the fluid reservoir.

Another difference between the construction of FIGS. 1 and 4 lies in the construction of the feedback valve 128A that is mechanically linked to load piston rod 123.

Feedback valve 128A variably vents fluid passages 61 and 63 via grooves 135 and 137, which, in this case, are connected together to form one long groove. Venting through grooves 135 and 137 can also be outwardly into the spaces 220 inside annular sealing boots 221 and thence through groove 222 back to the reservoir. When feedback valve 128A has moved far enough to equalize the pressure in fluid passages 61 and 63, piston 101 moves back to neutral position. Load piston 119 remains in its new position as controlled by the setting of manual obstructor 39A.

Another difference between the embodiments of FIGS. 1 and 4 lies in the fact that in the FIG. 4 construction the amplifier piston 101 is not provided with feedback grooves in its ends like the grooves 89 and 91 of the FIG. 1 embodiment.

Figure 5:
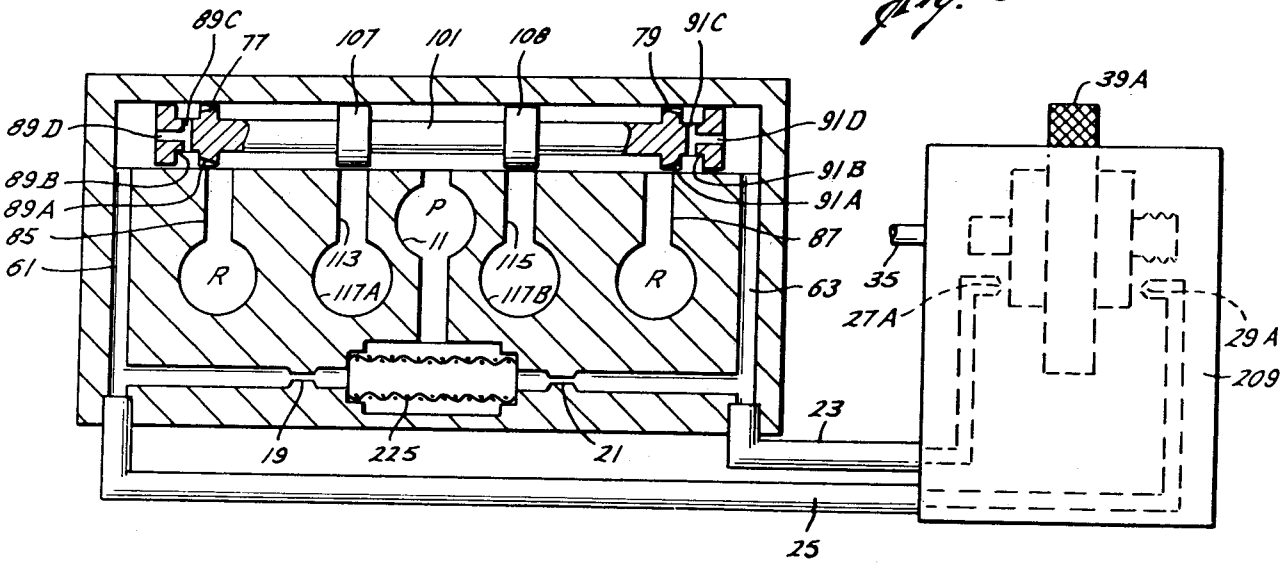

Referring now to FIG. 5 there is shown a further embodiment similar to the embodiments of FIGS. 1–4 wherein like reference numbers refer to like parts that will now be redescribed. As in the FIG. 4 construction, the FIG. 5 embodiment includes a manually actuated hand wheel type obstructor 39A cooperating with nozzles 27A and 29A, rather than an electric motor actuated spool 39 cooperating with ports 27 and 29 as in FIGS. 1–3. However, as in FIGS. 1–3, the amplifier piston is provided with feedback means. In the FIG. 5 construction instead of providing the ends of amplifier piston 101 with sloping grooves as at 89, 91 extending all the way to the outer ends of the piston as in FIGS. 1–3, the sloping grooves 89A and 91A of the FIG. 5 construction terminate where they run into and communicate with annular grooves 89B and 91B around the lands 77 and 79 respectively. Grooves 89B and 91B in turn communicate with the piston's ends via radial and axial flow passages 89C, 89D and 91C, 91D. Shape of grooves 89A and 91A is shown more clearly in larger scale detail views of FIGS. 6, 7 and 8. Short grooves 89A and 91A cooperate with annular grooves 89B and 91B to provide non-linear feedback correlative to the non-linear input of nozzle obstructor 39A. This effects a more nearly linear proportionality between hand wheel movement and amplifier piston movement.

Figure 9:
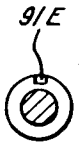
FIG. 9 is a view similar to FIG. 8 showing another embodiment.
Figure 8:
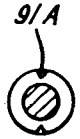
FIGS. 6, 7, and 8 are elevational, sectional and end views respectively of the end of the amplifier piston of the FIG. 5 embodiment.

FIG. 9 shows feedback groove 91E of rectangular cross section as an alternative to the V-shape cross section of groove 91A of FIG. 8.

No load cylinder and piston are shown in the FIG. 5 construction, but it is to be understood that amplifier output passages 113 and 115 connect via passages 117A and 117B leading to a suitable load cylinder which usually will be provided with further feedback means as in FIGS. 1–4. Without a load feedback the load piston will ultimately move to the limit of its travel regardless of the magnitude of the input at obstructor 39. The rate of this movement of the load piston will vary in proportion to the magnitude of the input at obstructor 39A. In some applications the load feedback means of the FIGS. 1–4 embodiments could also be omitted.

FIG. 5 illustrates the use of a filter screen 225 between conduit 11 leading to the source of pressure fluid and the orifices 19 and 21. This is desirable to prevent blockage of the orifices by foreign matter. This constructional detail, though not shown in FIGS. 1–4, is to be understood as being applicable to all embodiments of the invention.

Figure 10:
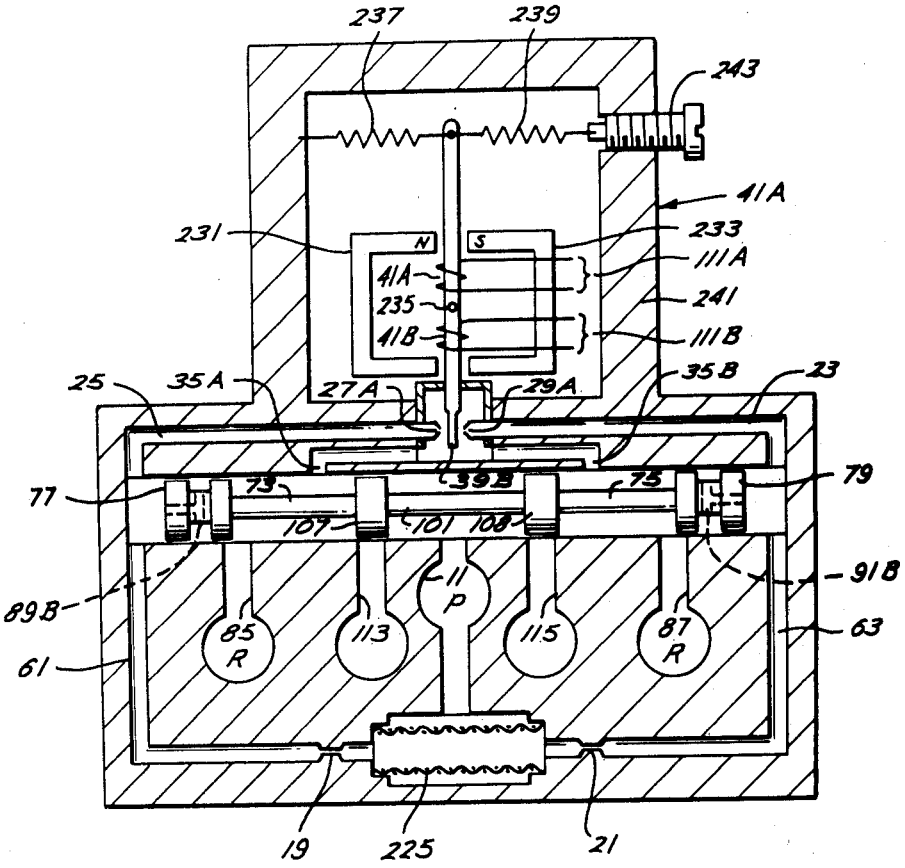
FIG. 10 is a cross-sectional schematic view of a mechanical to fluidic translator according to the invention.

FIG. 10 shows an embodiment of the invention that is much the same as that of FIG. 5. Differences include modification of the feedback groove system in the amplifier piston and the use of an electric "flapper" in place of hand wheel obstructor 39A. Like parts are given like reference numbers and their description will not be repeated.

The amplifier piston feedback groove system in FIG. 10 is similar to the system illustrated by FIG. 5 except short sloping grooves 89A dnd 91A are omitted. An initial axial motion of the piston 101 sufficient to communicate annular groove 89B or 91B with vent passage 85 or 87 is required before any feedback will occur. Thereafter, further movement of the piston 101 in the same direction will cause increasing venting.

Figure 11:
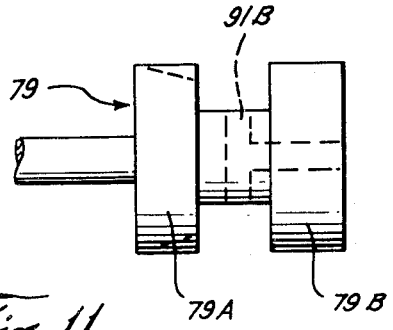
FIG. 11 is a sectional view of part of the spool valve shown in FIG. 10.

If desired, lands 77 and 79 can be inwardly flaring or tapered, e.g. conically or in other manner annularly relieved between annular grooves 73 and 89B along end and between annular grooves 75 and 91B at the other end, as shown in FIG. 11. This will effect a result similar to that attained by the embodiment illustrated in FIG. 5. The outermost parts of the lands will be cylindrical, for guide purposes, as shown at 79B.

Electric flapper 41A shown in FIG. 10 driving flapper type obstructor 39B includes horseshoe magnets 231 and 233 disposed opposite pole to opposite pole with flapper 39B pivoted therebetween at 235. Tension springs 237 and 239 connected to one end of the flapper and to motor housing 241 and adjustment screw 243 normally centers the other end of the flapper between nozzles 27A and 29A. When an electric signal is applied to either input 111A or 111B of solenoid 41A or 41B the flapper is magnetized a proportional amount. This moves it toward or away from nozzle 27A or 29A. This variably vents passages 23 and 25. Fluid leaving nozzles 27A and 29A returns to the fluid reservoir through passages 35A and 35B.

Figure 14:
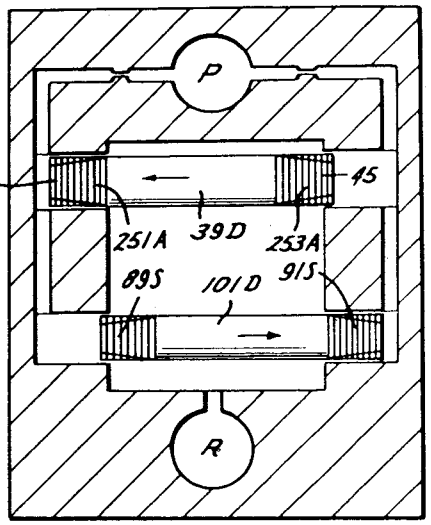
FIGS. 12, 13 and 14 are largely schematic sectional views showing further embodiments of the invention.
Figure 13:
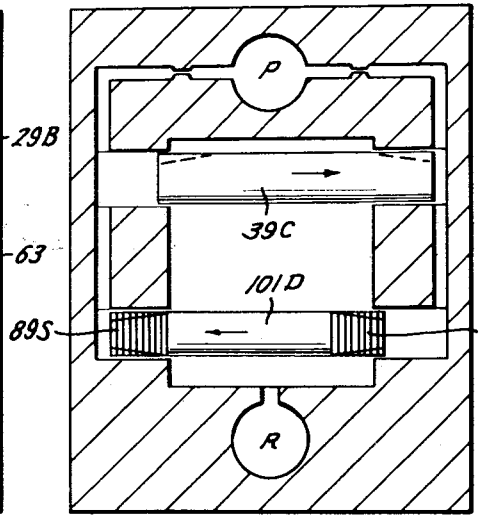
Figure 12:
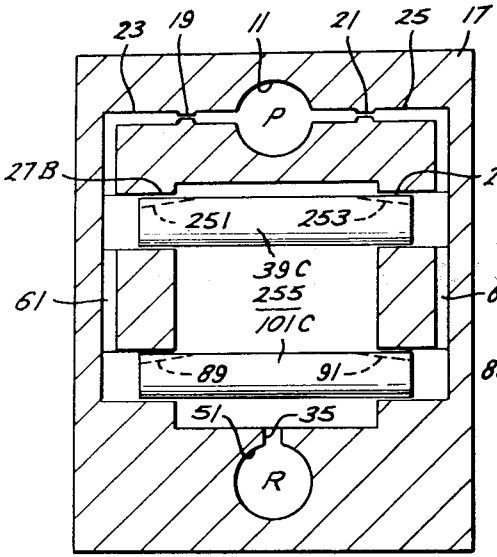

FIGS. 12–14 show rudimentary fluidic repeater apparatus according to an embodiment of the invention in which transmitter obstructor 39C or 39D is of the needle valve type rather than the spool valve type shown in FIGS. 1–3 or the jet interference types shown in FIGS. 4, 5, and 10. In FIG. 12 obstructor 39C is a cylindrical plug axially movable relative to cylindrical ports 27B and 29B. Plug 39C is provided with sloping grooves 251 and 253 similar to grooves 89 and 91 of the amplifier piston of FIG. 1. According to the axial position of plug 39C more or less fluid is vented from fluid source passages 23 and 25 to chamber 255 and then through passage 35 to reservoir return conduit 51. No means for moving plug 39C is shown, but it is to be understood that any suitable means can be used, e.g. any of the manual or motor means used in the previously described embodiments.

Figure 16:
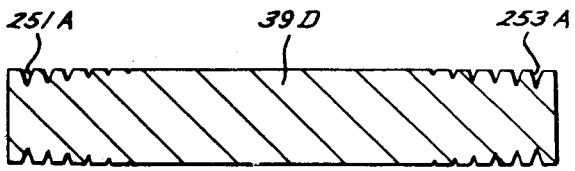
FIGS. 15 and 16 are sectional views of feedback elements of the embodiments shown in FIGS. 12 through 14.
Figure 15:
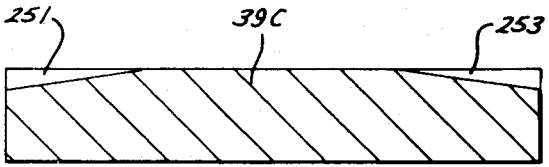

The transmitter obstructor shown in FIG. 13 is the same as that in FIG. 12. The transmitter obstructor shown in FIG. 14 is the same as in FIGS. 12 and 13 except that the ends of the obstructor plug 39D are provided with spiral helical grooves 251A, 253A spiraling inward and progressing axially towards the plug ends, rather than the sloping grooves 251, 253 of the embodiments of FIGS. 12 and 13. The two groove constructions are further illustrated in FIGS. 15 and 16.

Referring once more to FIG. 12, receiver piston 101C is provided with sloping feedback grooves 89 and 91 similar to those shown in the embodiments of FIGS. 1–3 whereby axial motion of piston 101C due to difference in pressure between fluid passages 61 and 63 causes such venting through chamber 255 and passage 35 to reservoir return conduit 51 as to eliminate the pressure differential. The receiver piston constructions of FIGS. 13 and 14 are the same as that of FIG. 12 except that instead of sloping grooves 89 and 91 of configuration like transmitter grooves 251 and 253, the receiver pistons of FIGS. 13 and 14 are provided with spiral helical grooves of configuration similar to the grooves 251A and 253A.

No amplification is effected between transmitter plugs 39C and 39D and receiver pistons 101C and 101D. No load is shown connected to pistons 101C or 101D, but it is to be understood that they can be connected fluidically to load cylinders and pistons as are the amplifier pistons in the other embodiments, or mechanically, the same as feedback piston 133 in FIG. 1, for example, or pistons 101C and 101D could be connected to indicator or display means of minimum load power requirements.

The various vent groove configurations described herein as applicable to the transmitter plug (FIGS. 15 and 16), the amplifier or receiver piston (FIGS. 1–3, 5–14) and the load feedback piston (FIGS. 1–4) may be interchanged between the various embodiments described hereinabove or hereinafter, as may be desired or required for any reason, for example to correlate the transmitter obstructor position-vent function, the amplifier piston position-vent function, and the load feedback valve position-vent function.

Comparing the several embodiments of the invention thus far described it will be seen that operationally in each case a transmitter obstructor moves relative to a pair of openings. These may be side ports in a spool valve as in FIG. 1, jet nozzles as in FIGS. 4 and 10, or needle valve ports as in FIGS. 12–14. The obstructor and opening provide means to variably vent a pair of pressure fluid passages downstream from flow restrictors. Responder means, e.g. amplifier and/or load cylinders, are connected to the fluid passages. Feedback means from the amplifier and/or load cylinder variably vent the pair of fluid passages opposite to the variation by the obstructor. The feedback means comprises variable cross section surface passages in the amplifier or load or receiver piston or several of these or in the walls of the cylinders surrounding these pistons.

The responder means of the invention can be actuated by other forms of transmitter than those described above in which the transmitter variably vents a pair of fluid passages downstream from flow restrictors therein, the fluid passages upstream from the restrictors leading to a source of constant fluid pressure, and the pressures downstream from the restrictors being conducted by two fluid lines to the responder. Instead of variable venting, variable pressures can be generated by making the restrictors variable and conducting the downstream pressures by two lines to the responder. Furthermore, the transmitter may be modified to affect change in only one pressure. A single line may then be used between transmitter and responder. These various modifications will be described next.

Figure 17:
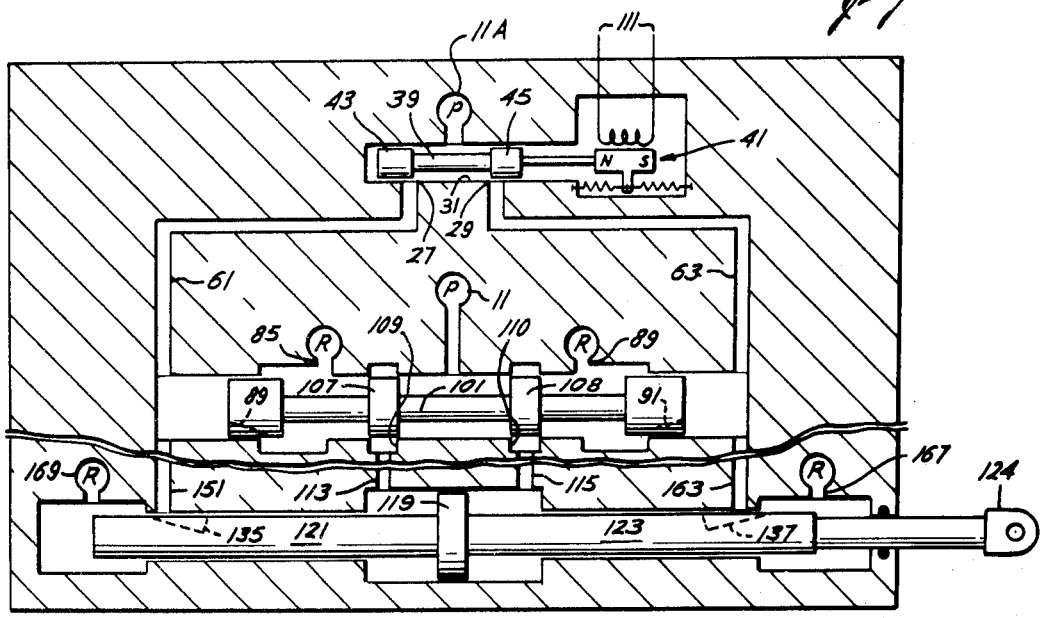
FIG. 17 is a largely schematic cross-sectional view illustrating a fluidic repeater according to an embodiment of the invention.

Referring now to FIG. 17 there is shown an embodiment to the invention, the same as that of FIG. 2 insofar as the amplifier and receiver are concerned, but employing a modified form of transmitter. Like parts are given like reference numbers. In this embodiment, motor 41 acts to move spool 39 axially in cylinder 31 to vary the position of lands 43 and 45 relative to ports 27 and 29, as in FIGS. 2 and 3. However, conduit 11A connected to cylinder 31 leads to a pressure source rather than to a reservoir. The pressure in lines 61 and 63 leading to amplifier piston 101 are varied in accordance with the degree of throttling, or obstruction, produced by spool 39. Thus this is an example of control by variable obstruction of a pressure source. There is always a sufficient flow from lines 61 and 63 to the return reservoir conduit, for example 85, 89, and 167, to prevent the pressure in lines 61 and 63 from building up to supply pressure despite the throttling effect of spool 39.

The operation of the embodiment illustrated in FIG. 17 is the same as that of the embodiment illustrated by FIG. 1, in that electric signals inputted through electric motor 41 moves spool 39 to vary the pressure in lines 61 and 63. This differential pressure in turn moves amplifier piston 101, causing ports 109 and 110 to be opened to the reservoir and pump pressure, respectively. The differential pressure thus applied to load piston 105 causes it to move axially, moving connected clevis 124 to actuate a load (not shown). Negative feedback, in accordance with the preferred embodiment of the invention, is effected by grooves 89 and 91 in the amplifier and by grooves 135 and 137 in the load piston. The feedback provided by these grooves limits the travel of both the amplifier and load pistons so the load pistons movement varies in an amount directly related to the amount of electrical input to motor 41. The precise relationship, linear or otherwise, between the signal strength and load movement depends on the size and shape of the feedback grooves.

It should also be noted that, due to the fact that the end areas of piston rods 121 and 123 that are exposed to reservoir pressure are different, piston 119 comes to rest at a balance of forces, not pressures. If, however, the reservoir pressure is atmospheric pressure, then the pressure on clevis 124 will effect a precise compensation and piston 119 will come to rest with a balance of pressures in lines 113 and 115, (assuming the load on clevis 124 exerts no force when the clevis is a rest).

Figure 18:
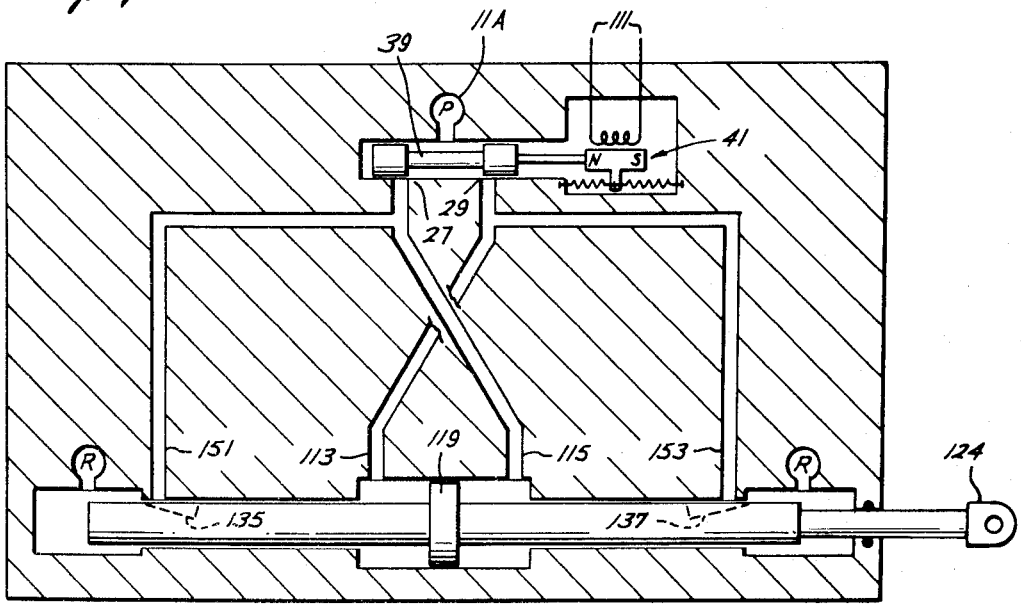
FIG. 18 is a view similar to FIG. 17 showing another embodiment.

Referring now to FIG. 18, there is shown a construction similar to that of FIG. 17 except no amplifier is employed. Like parts bear like reference numbers. It will be seen that variable pressures downstream of throttling spool 39 at port 27 and 29 are applied directly to loan piston 119 through lines 113 and 115. Negative feedback in accordance with the invention is effected by grooves 135 and 137 in the load piston. These grooves are always in position to vent some of the pressure fluid back to the reservoir so there will be no buildup of hydraulic fluid in lines 113 and 115 sufficient to lock the system.

Figure 19:
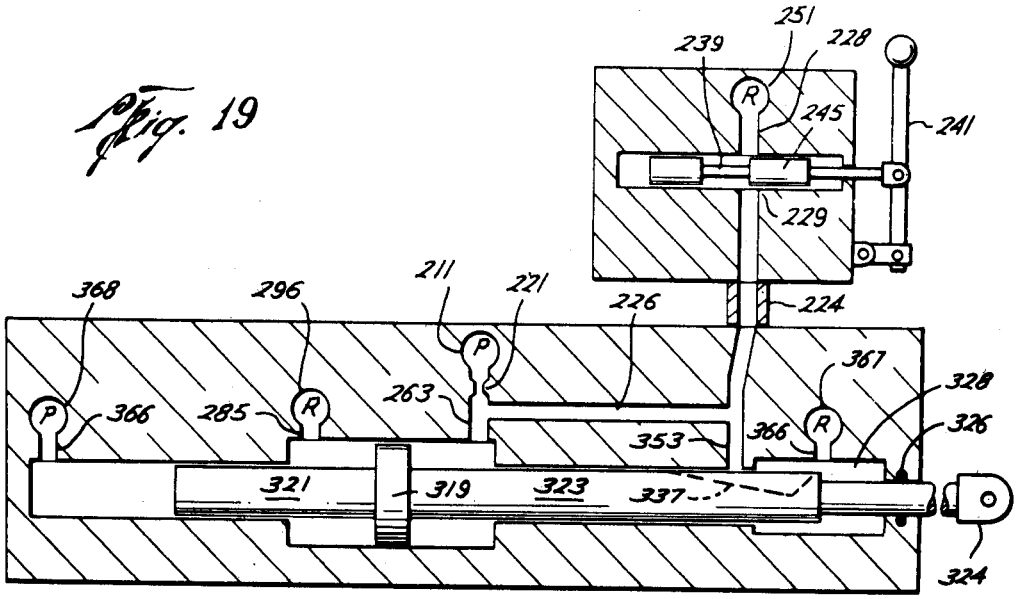
FIG. 19 is a view similar to FIG. 18 showing an embodiment of the invention using only a single pressure line for control.

Referring now to FIG. 19, there is shown another embodiment of the invention adapted for a single line connection between the transmitter and receiver. The construction is similar to that of FIG. 18 in that no amplifier is used and similar to that of FIG. 2 in that the transmitter functions by variably venting the working fluid rather than by variably throttling it to effect pressure change. Reference numbers for parts similar to those of FIG. 2 will be employed, increased by 200.

The transmitter of FIG. 19 employs a manual input in the form of lever 241, which moves spool 239 axially. By this means single line 224 is variably vented to returnto-reservoir conduit 251. Venting varies in accordance with the position of land 245 relative to ports 228 and 229.

Load piston 319 is connected on one side by fluid passage 263 and flow restrictor 221 to conduit 211, which leads to the source of pressure fluid. Fluid 224 is connected to passage 263 by branch line or passage 226. The flow of fluid in this branch passage is used to vary the pressure of the fluid in passage 263 applied to one side of load piston 319. Pressure on the opposite side of piston 319 is maintained constant, e.g. by connection through passage 285 leading to a conduit connected to a reservoir. Similarly, the area at the end of piston rod 321 is connected by passage 366 to conduit 368. This conduit leads to a source of fluid pressure that may or may not be the same pressure source as is connected to conduit 211.

By varying the pressure on the variable pressure end of load piston 319 and piston 321, the pressure required on the right of load 319 and piston rod 323 can be adjusted required to make the system responsive to movement of transmitter actuator 241.

Piston rod 323 is connected to clevis 324 for actuating a load (not shown). The aperture through which the clevis extends out of the receiver housing is sealed by Oring 326. This prevents leakage from chamber 328 at the end of piston rod 323. The chamber is connected by passage 366 to conduit 367. This conduit leads to a reservoir. In accordance with the invention, negative feedback is achieved by the use of groove 337 in piston rod 323 that variably connects chamber 328 to fluid passage 353. Fluid passage 353 is connected to line 224 and passage 226.

When actuator 241 is moved to allow venting to increase in line 224, fluid pressure drops in passage 226 causing piston 319 to move to the right as illustrated in the drawing. Such movement causes groove 337 to also move to the right whereby only its shallow left end portion connects passage 353 to chamber 328. Venting, by passage 353, is thereby reduced, raising the pressure in passage 226 and bringing piston 319 to rest.

When actuator 241 is moved to the left as shown in the drawing, venting is decreased in line 224. This results in a pressure rise in passage 226 causing piston 319 to move to the left. Such movement causes groove 337 to also move to the left whereby its deeper right ended portion connects passage 353 to chamber 328. This increases venting through passage 353, lowering pressure in passage 226 and bringing piston 319 to rest.

While the use of a single line connecting the transmitter and receiver has the advantage of structural simplicity, its operation is dependent upon the maintenance of predetermined pressure in the supply and reservoir conduits 351, 211, 368, 286, and 367. On the other hand, with the two line system previously described, only the pressure differential between the two lines is significant. Both single and dual line systems are described herein in order to illustrate the scope of the invention that is directed primarily to the negative feedback means that allows a load piston's movement to be a function of the movement of the transmitter actuator. This is true whether the actuator variably blocks a pressure source, blocks venting to a reservoir, or differentially changes the pressure in two lines.

Figure 20:
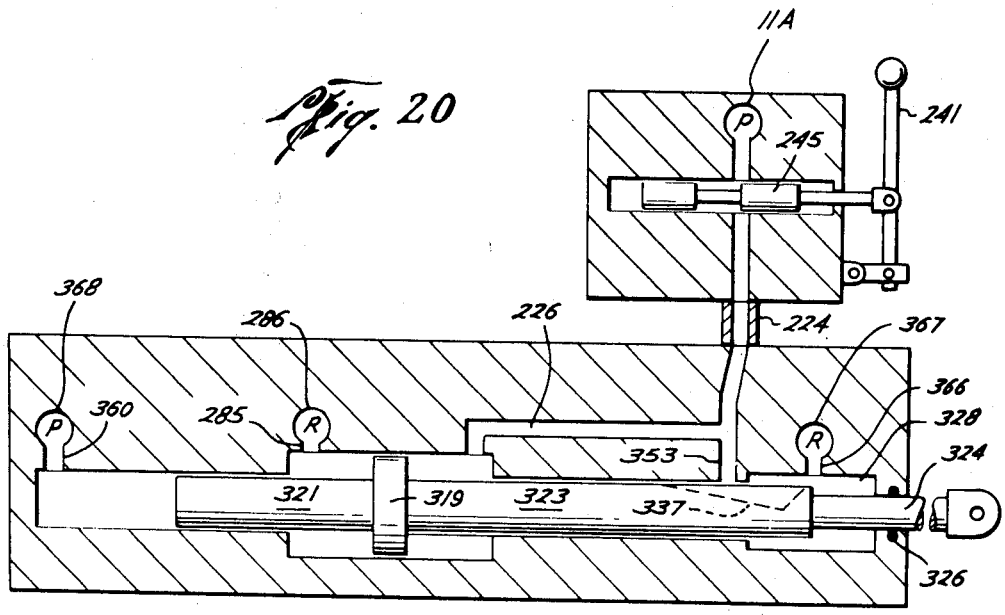
FIGS. 20 and 21 are views similar to FIG. 19 showing other embodiments of the invention using single control lines.

Referring now to FIG. 20 there is shown an embodiment to the invention that is the same as that of FIG. 19, except the transmitter functions by variable throttling as in FIG. 18 instead of by variable venting as in FIG. 19. Like parts are given like numbers to the constructions shown in FIGS. 18 and 19, whereby the operation will be obvious and repeated description rendered unnecessary.

Briefly, movement of manual actuator 241 moves variable restrictor means 245 to variably throttle pressure fluid flowing from conduit 11A to line 224 and passage 226 to the right of piston 319. This causes piston 319 to move to the right or left according to whether pressure falls or rises. Negative feedback by groove 337 causes the initial pressure change in passage 226 to be eliminated, bringing the load piston to rest in a new position.

Figure 21:
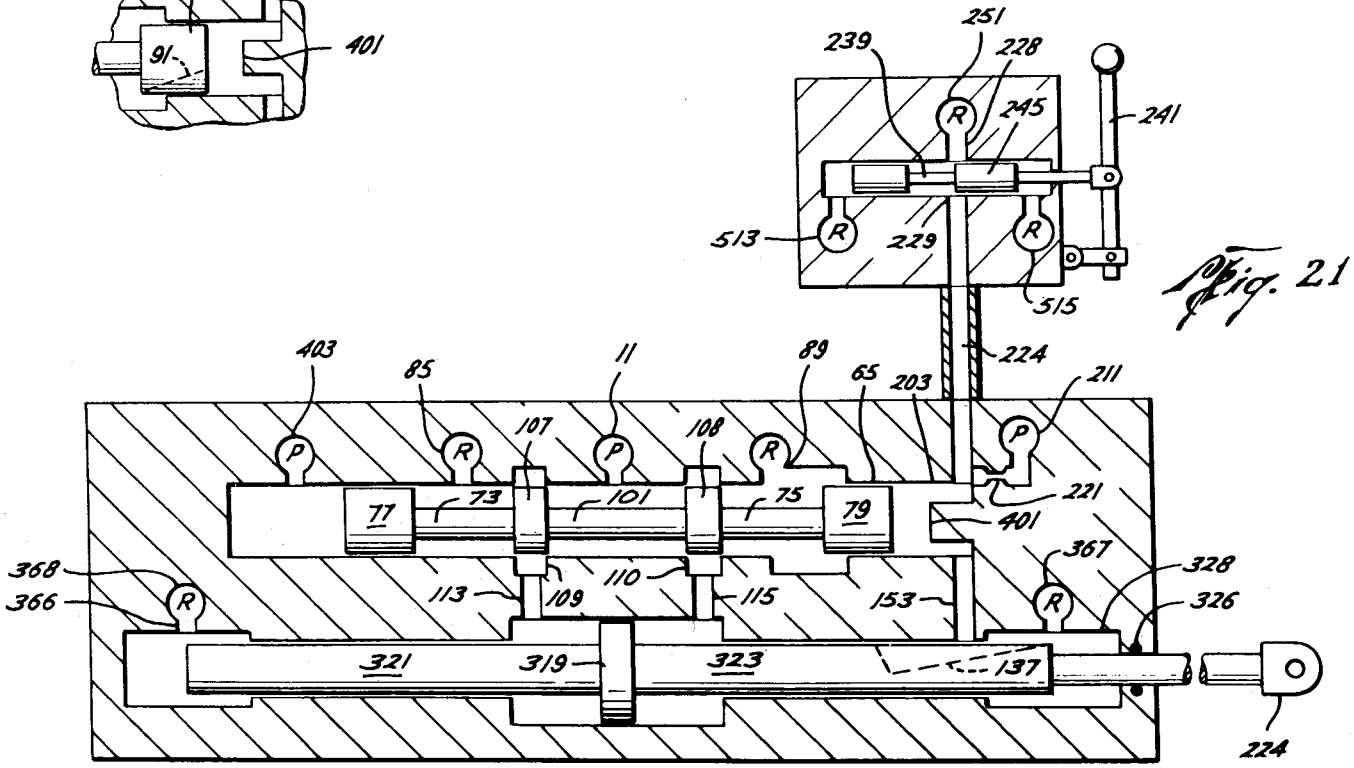

Referring to FIG. 21 there is shown an embodiment of the invention similar to that shown in FIG. 19. In this embodiment a single line is employed between transmitter and receiver and the transmitter functions by variable venting to create the desired pressure change. However, an amplifier is employed in this embodiment of the invention as was illustrated in FIGS. 2 and 17. As in FIG. 4, the amplifier, in this construction, is not provided with feedback means. Like parts are given like reference numbers.

Operationally, movement of manual actuator 241 to the right or left causes pressure to rise or fall respectively in line 224. This causes amplifier spool 101 to move to the left or right which in turn causes load piston 319 to move to the left or right. Feedback groove 137 increases or decreases the venting of passage 153 when the piston rod 323 moves to the right or left, thereby producing negative feedback to return amplifier spool 101 to its original position and bring the load piston to rest.

It may be pointed out at this time that the feedback groove tapers in different directions according to the requirements of the particular embodiment of the invention so as to always yield negative feedback in the system. If groove 137 in FIG. 31 tapered in a direction opposite to that shown in the illustration, positive feedback would be created that would accelerate the movement of the load piston toward its limiting position in one direction or the other; instead of producing a load piston position that is a direct known function of the movement of the manual actuator.

To insure that feedback passage 153 is never blocked off completely by land 79 on the amplifier spool, a pin 401 is provided at the end of cylinder 63 which moves the amplifier spool and limits its travel.

Figure 22:
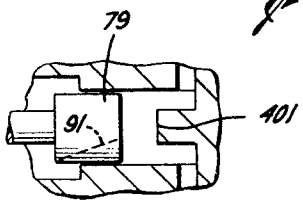
FIG. 22 is a sectional view of elements of the embodiments shown in FIGS. 20 and 21.

Referring now to FIG. 22 there is shown a variation of the amplifier piston illustrated by FIG. 21, constructed to incorporate a negative feedback groove 91. Negative feedback on the amplifier may be used in addition to or in place of negative feedback on the load piston. Preferably, negative feedback is employed with the load piston whether or not it is included in the amplifier. This prevents the load piston from tending to move toward the limit of its range of possible movement as soon as the transmitter activator is moved marginally.

Referring to FIG. 23, there is shown a further variation of the amplifier shown in FIG. 21. In the embodiment of the invention illustrated by FIG. 21 amplifier spool 101 is exposed to pressure by conduit 403 from a constant pressure source that is at a lower pressure than the pressure in conduit 211. This pressure opposes the variable pressure received by passage 263, which is responsive to the transmitter and causes the amplifier piston to move.

In the variation of the embodiment of the invention illustrated by FIG. 23, left end of amplifier spool 101 is exposed to reservoir pressure received through passage 404. A helical compression spring 405 is added to provide some of the reaction force on the amplifier spool needed to bring the spool into balance with transmitter pressure. This spring eliminates the need for an additional constant pressure source by providing a bias on piston 101. It also changes the system's response characteristics, since the reactive force provided by the spring varies with its degree of compression according to Hooke's Law. The spring is disposed concentrically around a pin 407, which centers the spring and functions like pin 401 (FIG. 21) to keep land 77 at the end of spool 101 from blocking passage 409 to conduit 407. If desired, the variation of the preferred embodiment of the invention illustrated by FIG. 23 can be used in conjunction with those novel features disclosed in FIG. 22.

Referring now to FIG. 24 there is shown a further variation of the amplifier initially illustrated in FIG. 21. In this construction, end 411 of amplifier spool 101 has a reduced end area so forces on the ends of the spool can be balanced by pressure acting on the left end of the piston from conduit 406. Conduit 406 is at the same pressure as conduits 211 and 11. This modification eliminates the need for spring 405 and provides a system having a different response characteristic because the pressure on spool end 411 remains constant. This construction can be used in combination with the feedback constructions illustrated in the embodiment of the invention shown in FIG. 22.

The embodiment of the invention illustrated in FIG. 21 can be modified for use with a variable restrictor or throttling type of transmitter. Such a variation is illustrated by FIG. 25. The operation of this type of transmitter is the same, operationally, as the embodiment shown in FIG. 20. It may be noted, however, that to prevent the possibility of hydraulic locking due to leakage around control land 245 and guide land 246 the ends of the transmitter cylinder are vented to reservoir pressure by conduits 513 and 515. A similar construction is used in the embodiment of the invention illustrated in FIG. 21. This variation of the preferred embodiment of the invention's transmitter illustrated by FIG. 25 can be used with any of the amplifier constructions illustrated by FIGS. 21 through 24.

Figures 26, 28, 29:
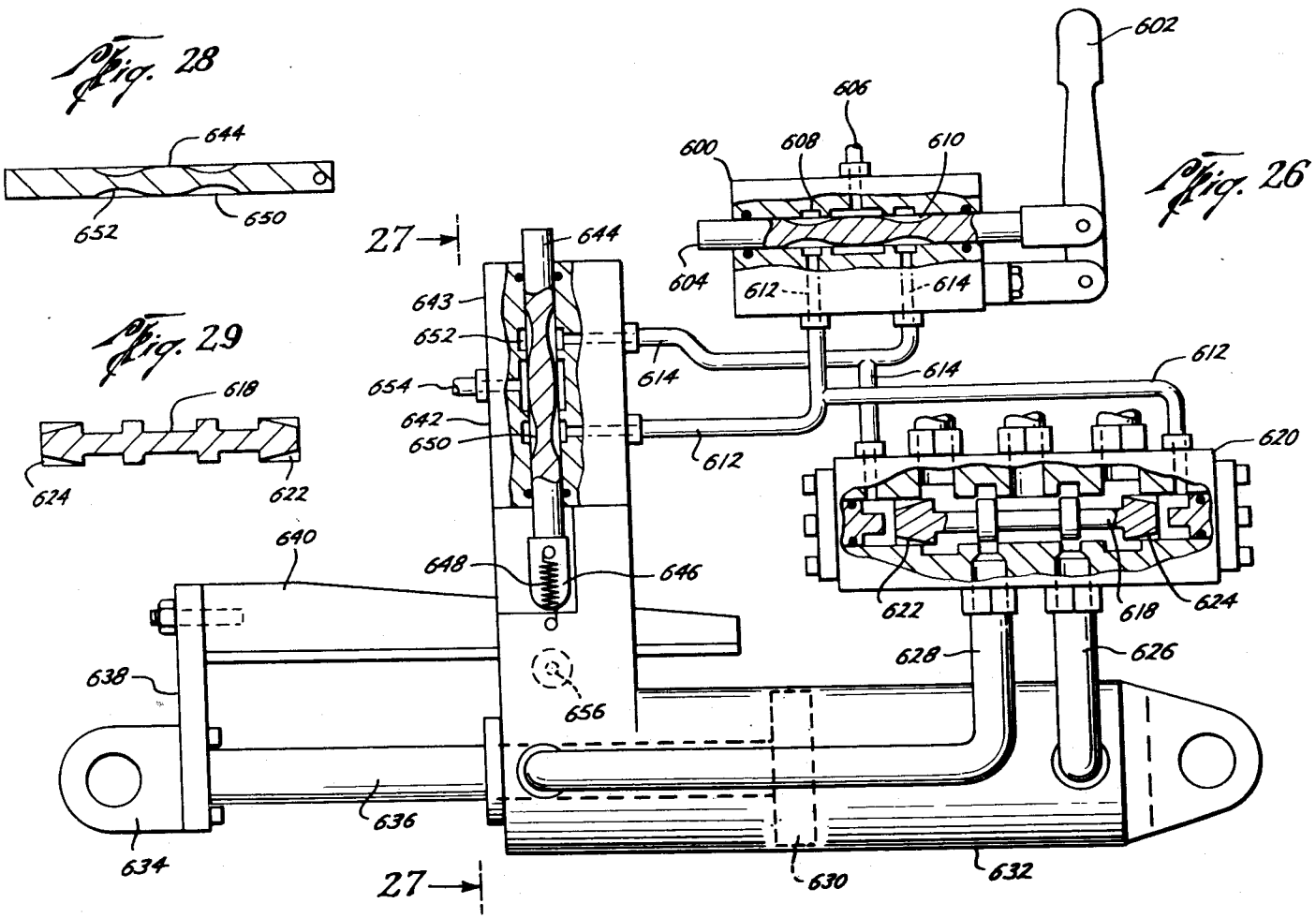
FIG. 26 is a fragmentary sectional view of a commercial embodiment of the invention.
FIGS. 28 and 29 are sectional views of valves used in the invention's embodiment depicted in FIG. 26.

FIG. 26 illustrates a commercial embodiment of the invention. In this embodiment transmitter 600 has a lever 602 connected to grooved valve rod 604 and adapted to move the valve rod to variably obstruct the flow of fluid from pressure conduit 606 through grooves 608 and 610, thus creating a pressure differential between lines 612 and 614. Differential pressure moves spool valve 618 in amplifier 620. Spool valve 618 is supplied with feedback grooves 622 and 624. Movement of the amplifier's spool valve creates a pressure imbalance between conduits 626 and 628. This imbalance of forces moves piston 630 in load cylinder 632 as has been described earlier. Piston 632 is connected to clevis 634 by rod 636. The clevis is attached to a plate 638, which is provided with a cam 640 used to actuate feedback 642. Feedback 642 has a body 643 in which is mounted a grooved valve 644. The valve is attached to a wheel 646 and constrained by spring 648 to move to a position dependent on the position of cam 640 and thus on the position of piston 630 and clevis 634. As the valve's position is varied by movement of load piston 630, lines 612 and 614 are variably vented via grooves 650 and 652 in valve rod 644 to return line 654. This venting tends to reduce the pressure imbalance acting on the amplifier's spool valve causing it to return to a neutral position and stopping movement of the load piston. Hence the celvis and the load attached to it will come to rest at a position dependent on the displaced position of the transmitter's control lever 602.

In this commercial embodiment, the amplifier spool valve and load piston both incorporate feedback means taught by the preferred embodiment of the invention. These feedback means are shown working in cooperation to produce a final clevis position that is a known function of the control lever's position. Also, since the load piston has unequal areas exposed to the differential pressures from conduits 626 and 628, the load piston will come to rest at a balance of forces on its two sides rather than at a balance of pressures in lines 626 and 628.

Figures 27, 30, 31:
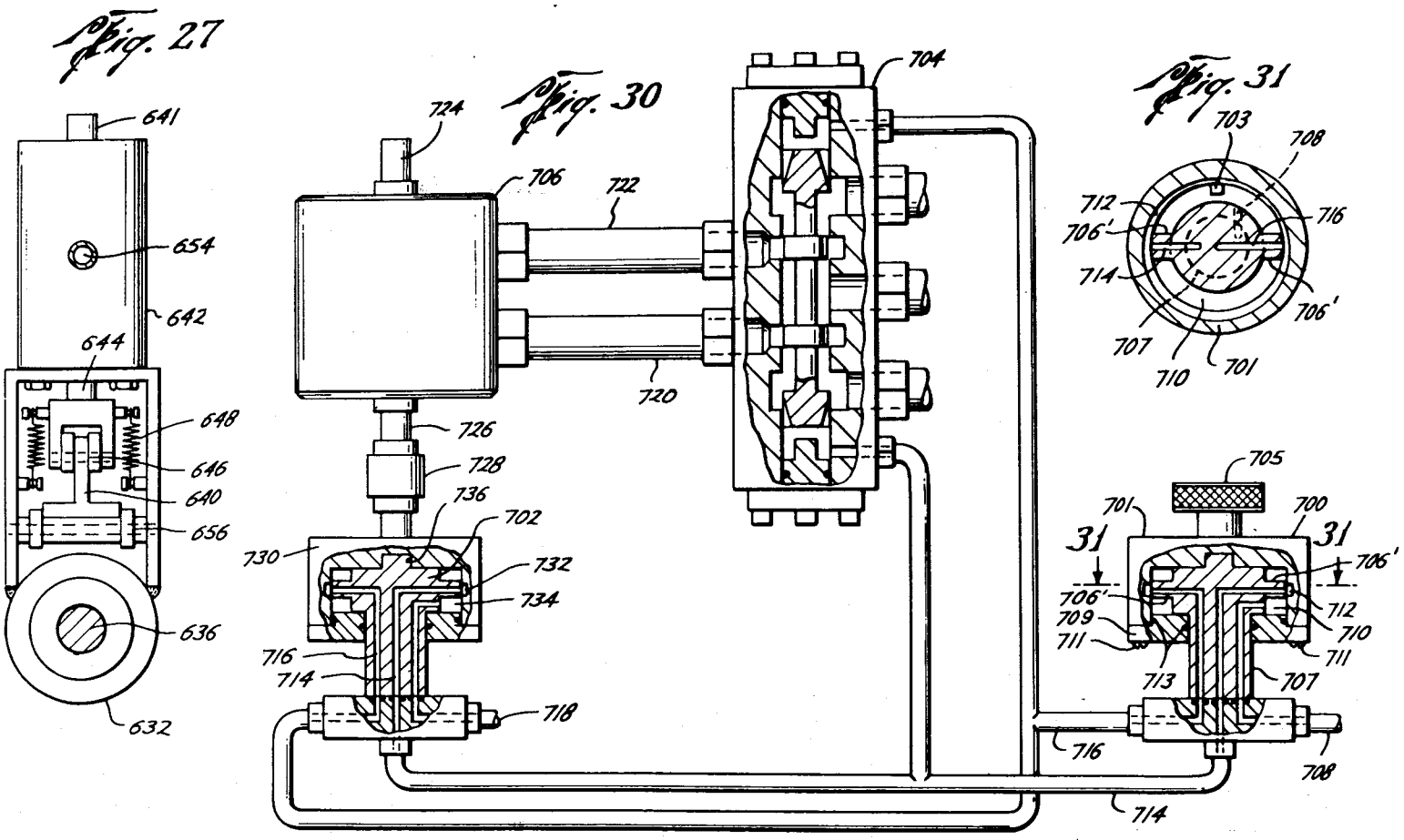
FIG. 27 is an elevational view of a section of FIG. 26 taken along lines 27—27.
FIG. 30 is a partially sectional view of another commercial embodiment of the invention.
FIG. 31 is a sectional view of the transmitter illustrated in FIG. 30 taken along lines 31—31.

FIG. 27 shows an isometric view of feedback 642 along lines 27—27 of FIG. 26. Springs 648 are shown biasing roller 646, which is attached to valve rod 644, into contact with inclined form 640. The cam which is shown as being "T" shaped in this illustration, rests on lower roller 656, which is a guide roller.

FIGS. 28 and 29 illustrate sectional views of the feedback valve rod and amplifier spool valve, respectively, clearly showing the feedback grooves taught by the preferred embodiment of the invention.

FIG. 30 illustrates a second commercial embodiment of the invention. In this embodiment a rotary transmitter 700 and a rotary feedback 702 operate with an amplifier 704, which is substantially the same as amplifier 620 illustrated and described in FIG. 26, and hydraulic motor 706 to produce a rotary fluidic servo system.

Transmitter 700 has a rotatable head 701 contstrained by stop 703 (see FIG. 31) to be rotatable by wheel 705 through 180 degrees. Head 701 is mounted concentric to and rotatably on control shaft 707 so as to define therebetween an annular space 710. Inside of head 701 there is an eccentric circular groove 712. Bottom plate 709 is affixed to head 701 with screws 711. Seal rigns 713 maintain the pressure integrity of the transmitter.

Fluid under pressure is introduced from a source, not shown, to conduit 708. This pressurizes annular space 710 that is in fluid communication with eccentric groove 712. This eccentric groove, which is clearly illustrated in FIG. 31, differentially pressurizes conduits 714 and 716 that extend to the ends of radially projecting arms 706' on shaft 707, and are connected to the control inputs of fluidic amplifier 704. As conduits 714 and 716 are differentially pressurized by fluid flowing under pressure through their respective sections of groove 712, amplifier 704 acts to control hydraulic motor 706 by establishing differential pressures in output conduits 720 and 722. Motor 706 has a two ended output shaft. End 724 is connected to a load or indicator as may be appropriate. End 726 is connected through coupling 728 to the rotary head 730 of feedback 702. Feedback 702 is structurally identical to transmitter 700. In the feedback differentially pressurized conduits 714 and 716 are variably vented via eccentric groove 732 through communicating chamber 734 to conduit 718, which is connected to a fluid reservoir, not shown. Variable venting tends to equalize pressures in conduits 714 and 716, causing the rotation of shaft 724 of hydraulic motor 706 to cease at a position that is a known function to the rotational displacement of transmitter 700's control knob 705. Stop 703 is adapted to prevent the rotation of eccentric groove 712 in head 701 past its point of greatest flow with respect to the conduits opening into said eccentric groove from control shaft 707. A similar stop, not shown, performs the same function with respect to venting these conduits in feedback 702.

FIG. 31 is a sectional view of transmitter 700 taken along line 31—31. It illustrates the fluid communication of conduits 714 and 716 with eccentric groove 712 and shows the differential variable obstruction provided by the groove between conduit 708 and each of conduits 714 and 716. The geometry of this eccentric groove may be varied in both the transmitter and the feedback to obtain a desired feedback function between the transmitter and the load in the illustrated servo system.

Figure 32:
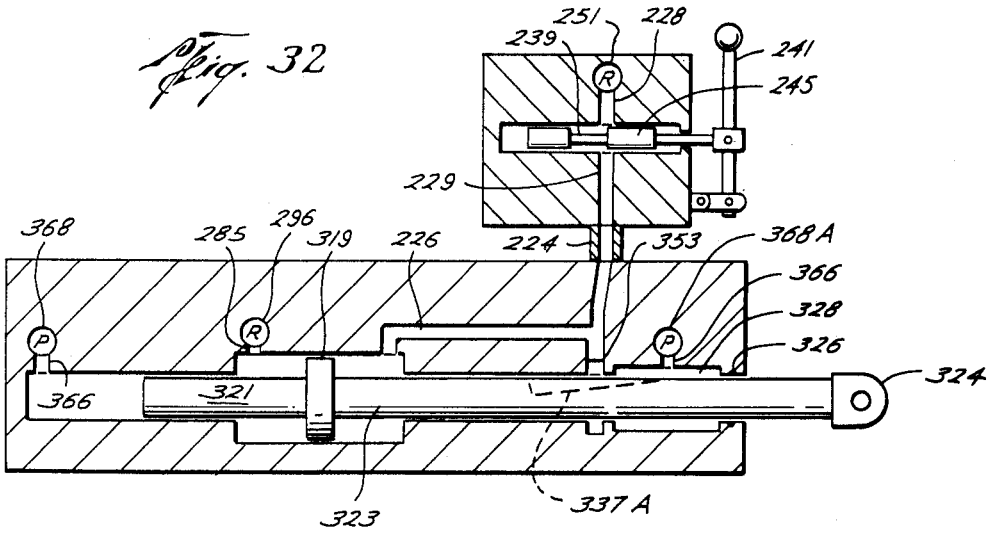
FIG. 32 is a largley schematic sectional view illustrating another embodiment of the invention somewhat similar to the embodiment of FIG. 19.

Referring now to FIG. 32 there is shown a single line fluidic repeater which is similar to that shown in FIG. 19 and like parts are given like reference numbers. However, feedback is effected by variable throttling of the fluid from pressure source 368A, which may be the same as source 368 or a different source at the same or different pressure, rather than variable venting to reservoir 367 as in FIG. 19. This effects a simplification in the number of fluid passages required as compared with the FIG. 19 construction. This also illustrates that the feedback need not always be effected by variable venting as in the previously described embodiments. The feedback groove 337A of FIG. 32 has a reverse slope compared to that of FIG. 19 due to the fact it is operating by throttling instead of venting.

Figure 33:
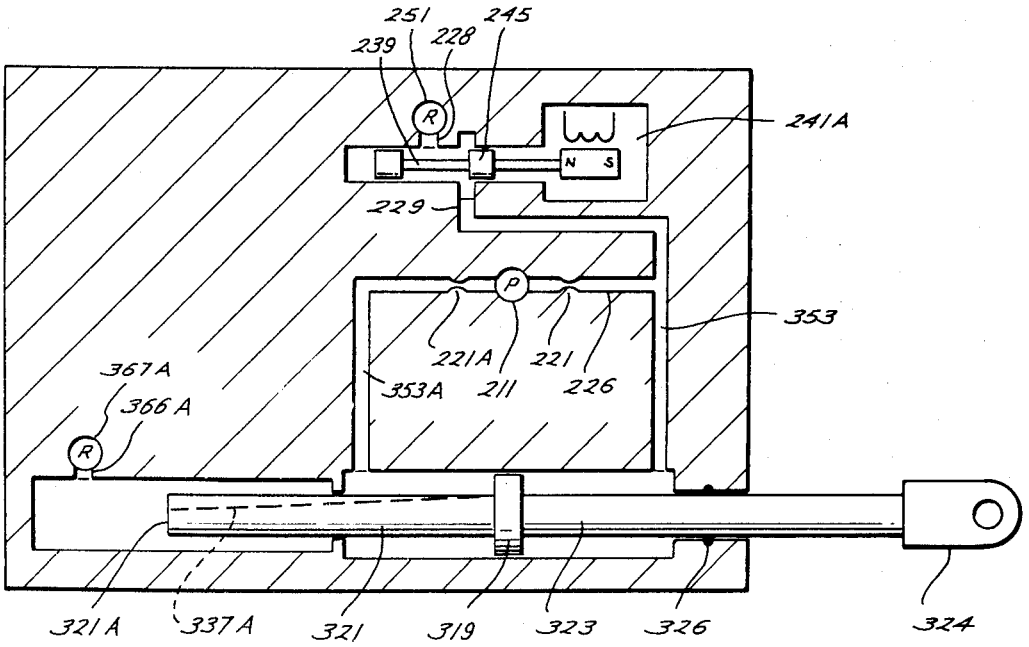
FIG. 33 is a view similar to that of FIG. 32 showing a further modification.

Referring to FIG. 33 there is shown a single line fluidic repeater which is similar to that shown in FIG. 19, like parts being given like reference numbers. A minor difference is that a torque motor 241A serves as an actuator in the FIG. 33 embodiment, taking the place of the manual actuator 241 of FIG. 19. More importantly, the feedback means including groove 337A and reservoir return line 366A is on the opposite side of the load piston from the variable pressure line 353 coming from the transmitter. Also, in FIG. 33 the piston end 321A is exposed to reservoir pressure rather than the reverse as in FIG. 19. In the FIG. 33 arrangement, the two sides of the piston 319 are both exposed to vented pressure fluid, vented by the transmitter on one side and vented by the feedback on the other side, and equal end areas of the piston are exposed to atmospheric or reservoir pressure, so that a balance is easily achieved without the need for a pressure source at the end of the piston rod as on FIG. 19.

Figure 34:
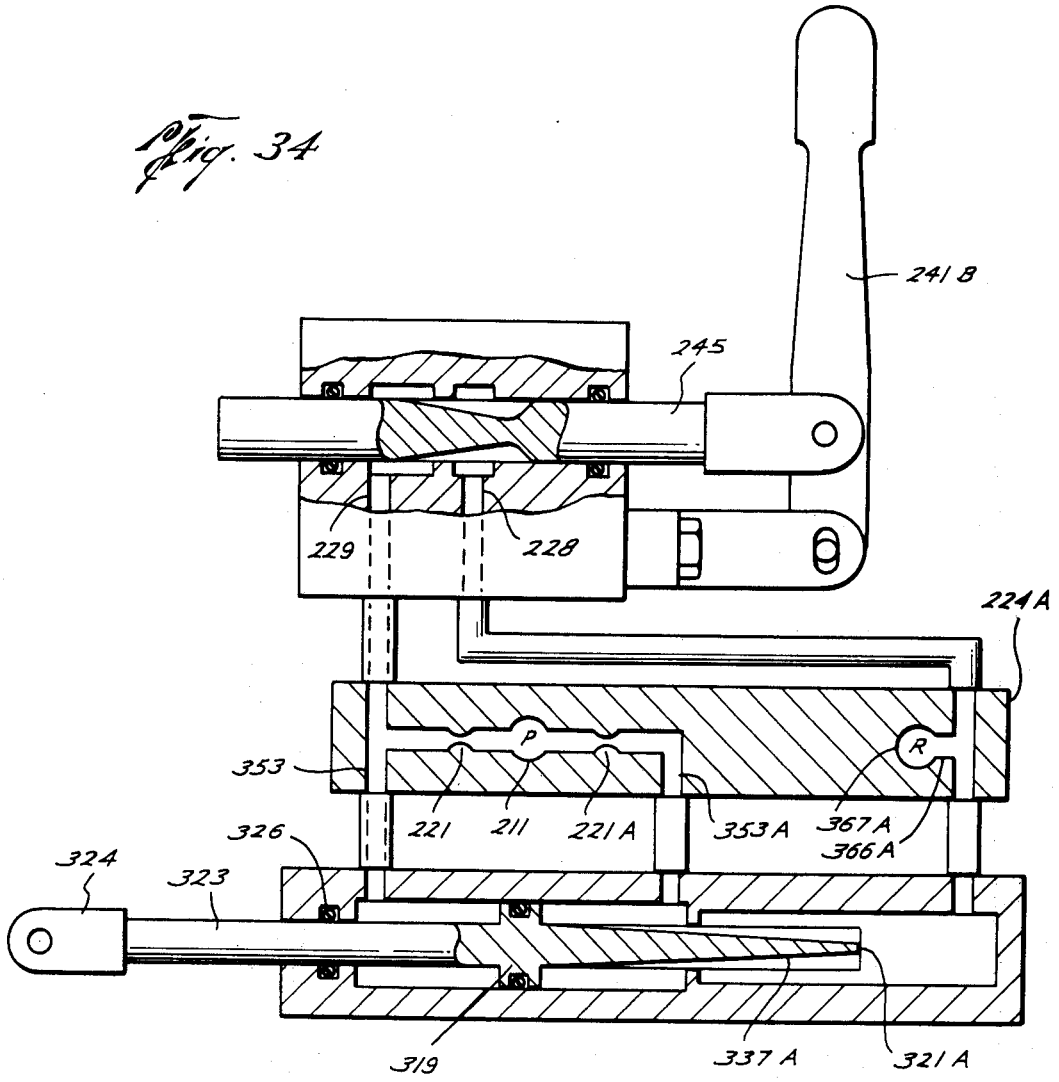
FIG. 34 is a view largely in section showing a commerical embodiment and slight modification of the apparatus shown in FIG. 32.

FIG. 34 is the same system as is shown in FIG. 33 but illustrates a commercial embodiment as distinct from the schematic showing in FIG. 33. Like parts are given the same numbers. Also, in FIG. 34 sink and source manifold 224A is provided to which connections are made as required for both reservoir pressure and for pump pressure.

Figure 35:
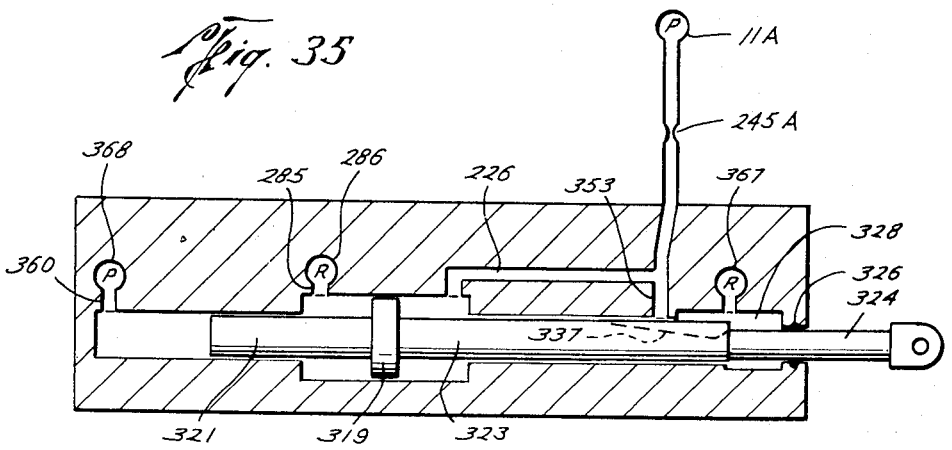
FIG. 35 is a largely schematic sectional view illustrating a modification of the invention shown in FIG. 20.

FIG. 35 illustrates a single line system the same as that shown in FIG. 20 except that the transmitter has a fixed choke 245A instead of a variable throttle valve 245. By changing the size of the choke 245A movement of this load piston can be effected. Operation would be in distinct steps rather than continuous.

Figure 36:
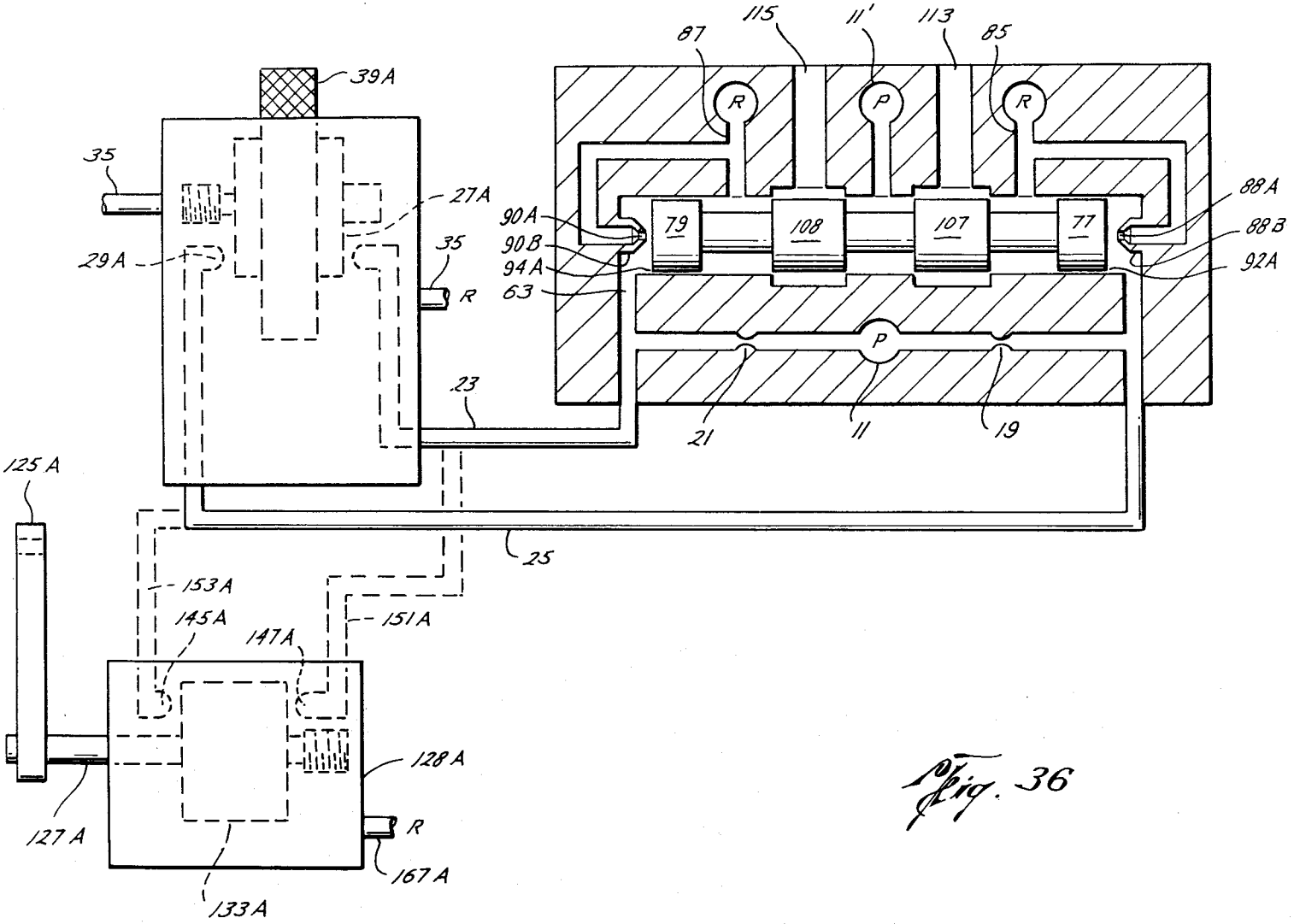
FIG. 36 is a largely schematic view partly in section illustrating a modification of a form of the invention shown in FIG. 5.

FIG. 36 illustrates an embodiment of the invention which is similar to that of FIG. 5, and like parts are given like numbers. However, instead of providing feedback grooves in the pistons 77, 79 as in the FIG. 5 embodiment, feedback vent ports 88A, 90A are provided in the tips of tubes 88B, 90B in the ends of the amplifier cylinder leading back to the reservoir via passages 85, 87. The ends 92A, 94A of the amplifier piston restrict flow through ports 88A, 90A to varying degrees according to the proximity of the piston ends to the ports, thereby providing variable venting according to the position of the amplifier piston. The tubes 88B, 90B provide stops limiting axial travel of the amplifier piston, preventing it from blocking the passages 61, 63 fron the transmitter.

FIG. 36 also illustrates the addition of a load feedback means inside of housing 128A (compare FIG. 1) actuated by the load via bar 125A. As the load piston, not shown but similar to that of FIG. 1, travels axially, the bar 125A connected thereto causes axial travel of bolt 127A and disc 133A secured thereto. Disc 133P variably restricts flow vent nozzles 145A, 147A according to the position of the disc relative to the nozzles. The nozzles are connected by fluid lines 141A, 153A to lines 23, 25, thereby to vent the ends of the amplifier cylinder. Disc 133A and nozzles 145A, 147A are located inside the housing 128A which is vented to the reservoir via passage 167A. The operation is like that of FIG. 1 embodiment.

Figure 37:
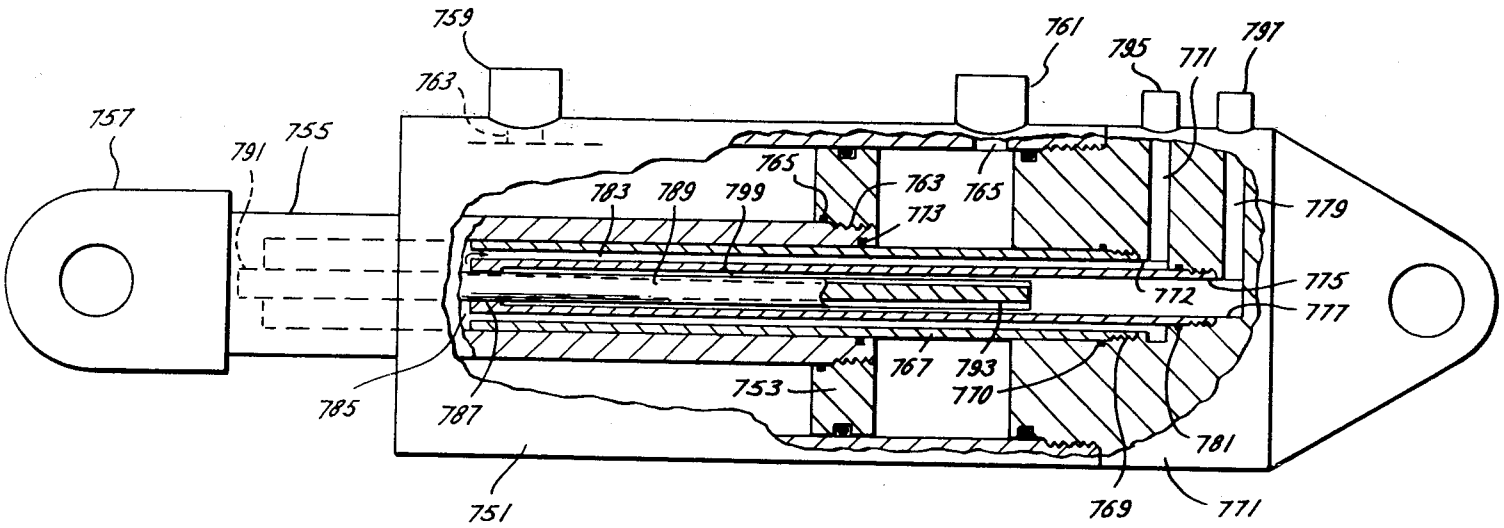
FIG. 37 is a side elevation, largely in section, of a load cylinder with a feedback means incorporated therein in accordance with one form of the invention.

Referring now to FIG. 37 there is shown a load cylinder 751 in which moves piston 753 to which is connected piston rod 755. A clevis 757 on the end of the rod provides means for making connection with a load to be driven. Fluid for moving the piston in the cylinder is supplied via fluid lines 759, 781 connected to ports 763, 765 in the side wall of the cylinder. For example, fluid lines 759, 761 could be connected to lines 113, 115 of the FIG. 21 construction in place of the piston and cylinder there shown. However, in addition to such substitution the load feedback means of the FIG. 21 construction would also be omitted for the load feedback means of the FIG. 37 construction, now to be described, would take its place. In the FIG. 37 construction the load feedback means is incorporated into the load piston and cylinder.

Referring once more to FIG. 37, piston rod 755 is tubular and is threadedly connected to a threaded hole 763 in piston 753, being sealed thereto by G-ring 765. A tubular stinger 767 is threadedly connected to a threaded socket 769 in cylinder head 771 and is sealed thereto by O-ring 770. Bore 772 at the bottom of socket 769 communicates with radial passage 771 in the cylinder head. Stinger 767 extends into piston rod 775 through the end thereof that is screwed into hole 763. Stinger 767 is sealed to piston rod 755 by O-ring 773 which provides a sliding seal.

Valve tube 775 is screwed into a threaded socket 777 beyond bore 772 in the cylinder head 771. Bore 777 in the bottom of socket 777 communicates with radial passage 779 in the cylinder head. Tube 775 is sealed to socket 777 by O-ring 781. Tube 775 extends concentrically inside stinger 776 and being of smaller outer diameter than the inner diameter of the stringer forms as annular fluid passage 783 therebetween. Passage 783 opens into the space 785 in piston rod 755. The free end of tube 767 is provided with an annular inturned radial flange whose inner periphery provides a needle valve seat 787. A needle 789 is screwed into a socket 791 in the closed end of the piston rod adjacent clevis 757. The needle is provided with one or more tapered grooves 793 on its outer periphery variably by-passing seat 787. It will be apparent that fluid lines 771, 779 in the cylinder head 771 will be interconnected via annular passage 793 in the stinger and the interior passage 799 in the valve tube, and that flow through such connection will be variably throttled or restricted by needle 789 and seat 787 according to the axial position of piston 753 in cylinder 751. When incorporated into the FIG. 21 construction, fluid lines 795, 797 would connect to fluid passage 153 and return conduit 367, and the needle valve controlled fluid path from lines 795 to 797 would provide the desired variable negative feedback means.

Referring now to FIG. 37 there is shown an application of the invention to a crane to be used for loading a floating vessel, the motion of the vessel being compensated whereby the crane operator can load the vessel much the same as if the vessel were stationary. The general system of such compensation is already known, e.g. from U.S. Pat. No. 3,309,065—Prudhomme et al, so that is need be described only briefly. Crane 801 includes a support means 803 which may be a fixed or mobile platform but in any case affixed to land or sea floor. A cab 805 is pivotally mounted on the platform for rotation about vertical axis. A boom 805 is pivotally mounted on the cab for swinging up and down about a horizontal axis. Motor means not shown are provided for rotating the cab and moving the boom up and down. A cable 807 is wound on a power winch (not shown) mounted in the cab. The free end of the cable passes over pulleys 809 811 on the end of the boom and thence down to a hook 815 supporting load 817 over floating vessel 817.

Hydraulic servo motor 819 includes therewithin a piston 821 having a rod 823 extending up toward cable 807. The rod 823 is provided at its upper end with a pulley 825 adapted to pull a bight in the cable as shown at 827 in dashed lines. The length of the bight is controlled in accordance with the up and down motion of the vessel 817 by means of transmitter 829.

Transmitter 829 is mounted on arm 831 pivotally mounted at 833 on a bracket 834 for swinging up and down about a horizontal axis, this bracket being mounted on platform 803 to be turnable about a vertical axis at 835. Servo cylinder means 837 is provided for adjusting the elevation of arm 831.

The transmitter has a drive stem 839 which is moved axially in accordance with the vertical position of vessel 817 by line 841. One end of line 841 is connected to arm 831. The line passes between pulleys 843, 845 mounted on drive stem 839 and a pole 847 affixed to arm 831. The line extends down and is attached at its other end to weight 849 resting on vessel 817. As the vessel falls, the weight 849 tensions the line, moving drive stem 839 out from transmitter 847. As the vessel rises, the tension in the line is reduced and the stem 830 moves back into the transmitter under the action of bias springs.

Figure 38:
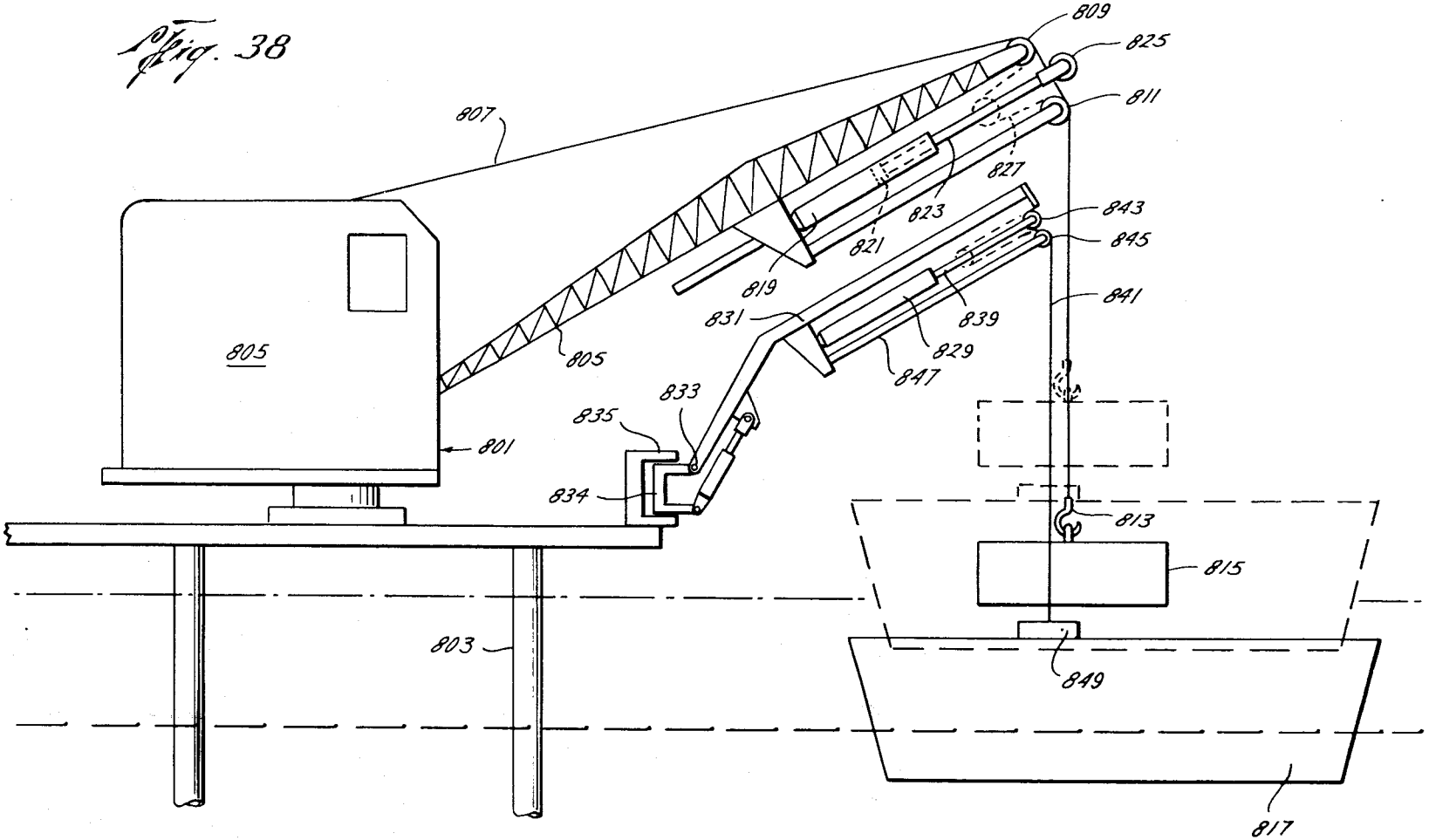
FIG. 38 is a side elevation, partly schematic, showing the invention incorporated in apparatus for loading a floating vessel by a crane located on a pier.
Figure 39:
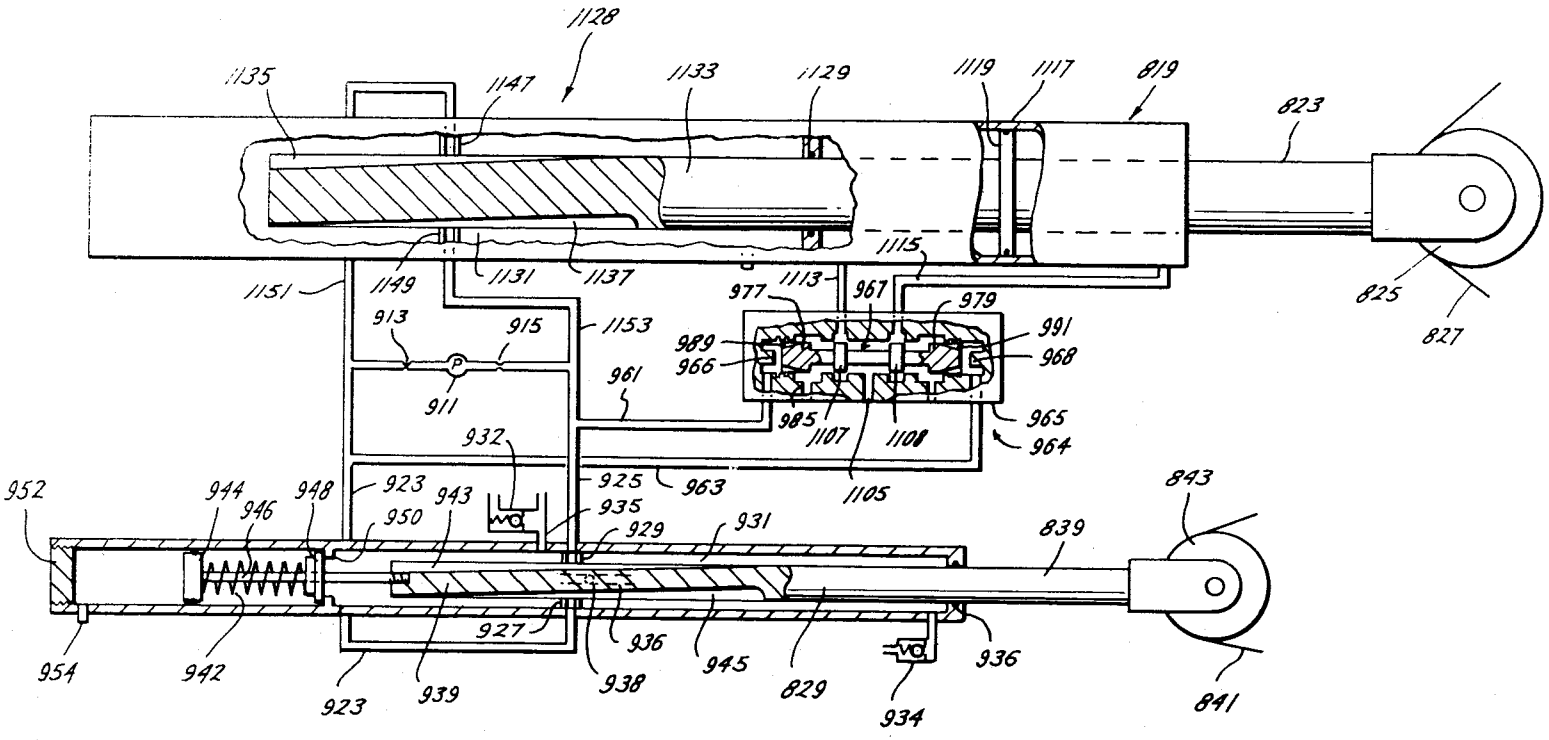
FIG. 39 is a largely schematic elevation, partly in section, of the hydraulic system and related parts of the apparatus shown in FIG. 38.

Referring now to FIG. 39 there are shown the details of the transmitter 829 and the servo motor 819 and the means connected therebetween, all in accordance with the invention. The system of FIG. 39 is operationally generally similar to that of FIG. 1 in that it includes a transmitter 829, amplifier with feedback, and load piston and cylinder 819 with feedback, for which reason the like parts will be given the same numbers as in FIG. 1 plus 900. Thus there is a source of pressure fluid 911, flow restricting orifices 913, 915, and output lines 961, 963. Vent lines 923, 925 lead to vent ports 927, 929 in transmitter cylinder 931. The ports open at the side of valve rod 939. Rod 939 has oppositely tapering longitudinal grooves 943, 945 extending along the length thereof aligned with ports 927, 929 whereby flow out of vent ports 927, 929 is variably restricted according to the axial position of valve stem 839 in accordance with the rise and fall of the vessel 817 (FIG. 38). Two spring loaded relief valves 932, 934 venting to the hydraulic sump prevent excessive pressure build up in cylinder 931. A seal 936 is provided at the end of cylinder 931 where valve stem 839 enters. A key-way 936 disposed at ninety degrees from grooves 943, 945 extends longitudinally of valve rod 939 the same distance as grooves 943, 945 and receives pin or key 938 extending inwardly from cylinder 93 to prevent rotation of rod 939, thereby keeping grooves 943, 945 aligned with ports 927, 929.

Suitable biasing means such as compression spring 940 bearing at one end against sealed piston 944 carried by extension rod 946 urges valve stem 939 to the left from the neutral position illustrated in which both vent ports 927, 929 are equally open or restricted. Spring 942 bears at its opposite end against washer 948 resting against pins 950. Travel of piston 944 is limited by screw plug 952 in the end of cylinder 931. A vent 954 to the hydraulic sump prevents pressure build-up in the cylinder 931 between plug 952 and sealed piston 944. When valve stem 839 moves from the position shown, ports 927, 929 are unequally opened or restricted, thereby creating a pressure differential between transmitter output lines 961, 963.

Lines 961, 963 lead to amplifier cylinder 965 in which moves free piston 967 between stops 966, 968 which prevent the piston from blocking the lines 961, 963 where they enter the cylinder. The details and operation of the amplifier 964 are the same as those of the amplifier of FIG. 1 and need not be described further. It may be noted, however, that because there are pairs of vent grooves 989, 991 at each end of piston 967, radial play is balanced out, radial movement tending to close up one of vent grooves 989 causing opening of the companion groove 989, and the same holds true for vent grooves 991. Instead of pairs of diametrically opposite vent groove, other numbers of azimuthally spaced vent grooves could be employed such as three at 120 degrees, four at 90 degrees, etc., to effect balancing out of the effects of radial play.

Output lines 1113, 1115 lead from the amplifier to servo motor 819 comprising load cylinder 1117 and load piston 1119. These function the same as the load cylinder 117 and piston 119 of the FIG. 1 embodiment, moving piston rod 822 back and forth in accordance with the movement of transmitter valve rod 839, thereby shortening and lengthening bight 827 to compensate for up and down motion of vessel 817 (FIG. 38).

The load feedback means 1128 is similar to that of FIG. 1 except that vent grooves 1135, 1137 are formed on opposite sides of an extension 1133 of piston rod 823, the cylinder 1131 in which the extension moves being an extension of the load cylinder 1117. The cylinder chambers are separated by seal 1129. Similar to the construction of transmitter 829, ports 1147, 1149 through the wall of cylinder 1131 cooperate with vent grooves 1135, 1137 and connect to lines 1151, 1153 leading back to the transmitter. The load piston 1119 is positively positioned hydraulically so no venting springs are required.

It will be noted that all of the various vents for the transmitter output lines 961, 963 are in parallel. In particular, the transmitter vents, the amplifier feedback vents, and the load feedback vents are all in parallel. Fluid being vented by the amplifier feedback vents does not flow through the flow restrictions of the transmitter vent system or those of the load feedback system. Fluid being vented by the load feedback vents does not flow through the restrictions of the transmitter or the amplifier feedback vents. Fluid being vented by the transmitter does not flow through the amplifier feedback restrictions or the load feedback restrictions. This makes possible multiple feedbacks which otherwise would be very difficult if not impossible to design. This independence of the several venting systems is an important feature of this invention.

Figure 40:
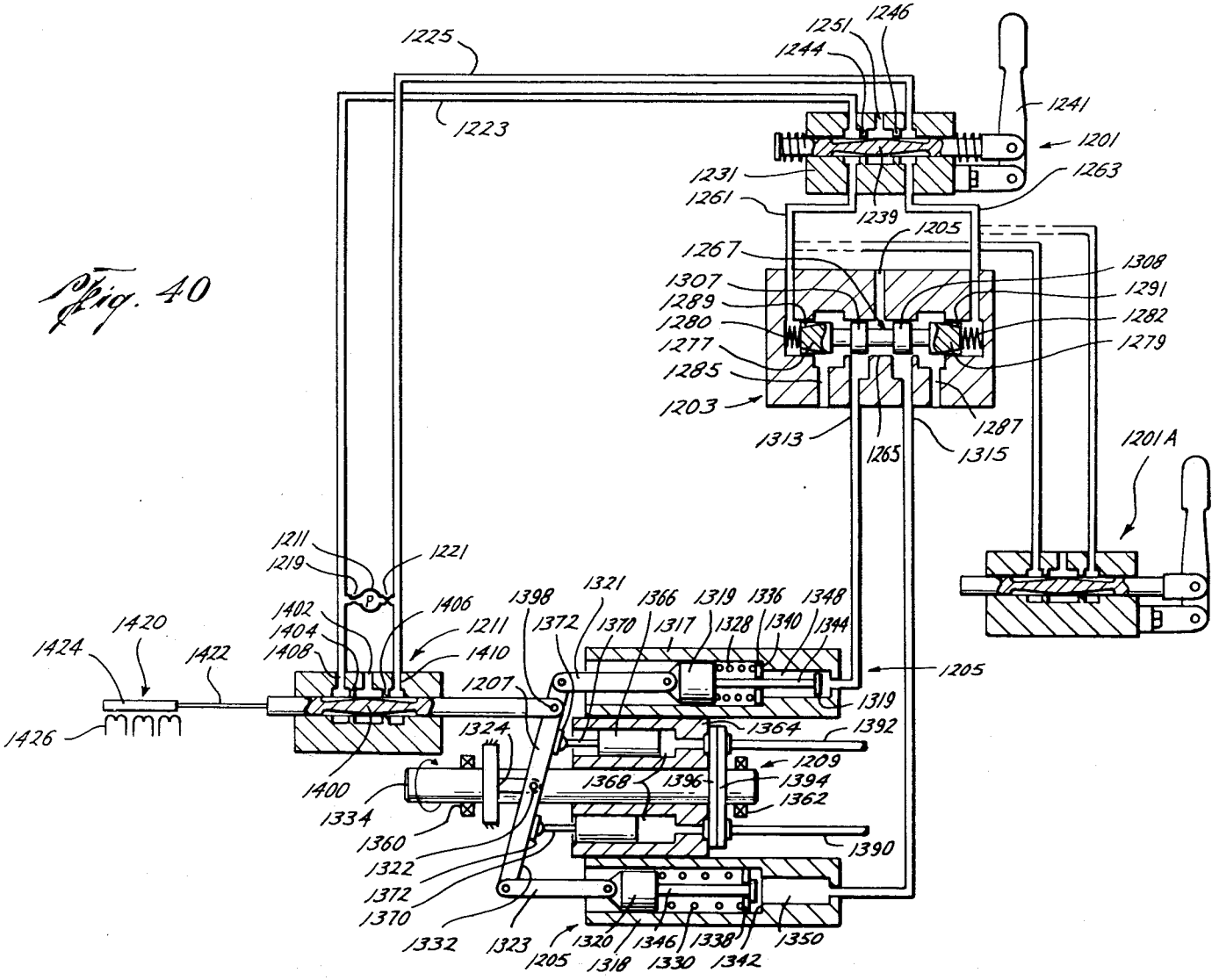
FIG. 40 is a sectional view of apparatus according to the invention incorporated into a system for varying the angle of a swash plate controlled motor-pump unit.

Referring now to FIG. 40 there is shown an embodiment of this invention in a servo control for a swash plate, e.g. a swash plate controlling a pump or motor. Servo controls for swash plates broadly stated are already known, for example, as disclosed in U.S. Pat. No. 3,302,585 to Adams et al, so that the swash plate pump need not be disclosed in great detail. The system disclosed herein will serve, however, to illustrate certain further variations of the subject servo system as well as the particular applicability of the subject system and its parallel independent feedback system for control of the angle of a swash plate.

The system includes a transmitter 1201, an amplifier 1203, servo motor means 1205, swash plate 1207, motor/pump 1209, and load feedback 1211. Except for the swash plate load, the system is similar to that of FIG. 1 and analogous or like parts will be given the same number as in FIG. 1 plus 1200.

The transmitter includes valve body or cylinder 1231 in which moves double tapered needle 1239. Needle 1239 is actuated manually by lever 1241 although motor means, e.g. as employed in FIG. 1 could be used if desired. The needle is urged to central or neutral position by springs 1240, 1242 disposed around the ends of the needle, the ends being enlarged to guide the needle in its axial travel within cylinder 1231. Suitable sealing means, not shown, is employed to seal between the ends of the needle and the cylinder. If desired, the centering spring could be omitted in which case the transmitter would be like that of FIG. 26.

According to the position of actuator lever 2141 and the resultant axial position of needle 1239, its tapered portions enter more or less into the valve seats 1244, 1246 to variably obstruct or throttle fluid flow from pressure fluid lines 1223, 1225 to reservoir port 1251. Lines 1223, 1225 are supplied from from pressure fluid source 1211 through flow restrictors 1219, 1221. The transmitter output lines 1261, 1263 are connected to amplifier 1203.

Amplifier 1203 includes cylinder 1265 within which moves free piston 1267. The ends of the piston are exposed to the pressures in lines 1261, 1263. Two lands 1277, 1279 at the ends of the piston are each provided with one, preferably two or more equiazimuthally spaced tapered grooves 1289, 1291 which vent pressure fluid from transmitter output lines 1261, 1263 to the reservoir through ducts 1285, 1287 in an amount varying according to the axial position of piston 1264. Helical compression springs 1289, 1291 urge the piston 1264 to its midposition. If the piston is displaced by pressure differential between lines 1261, 1263, it moves only an amount sufficient to restore balance. Balance is restored by reduced pressure differential caused by venting through feedback vent grooves 1289, 1291 and by increased and opposing differential spring force from springs 1289, 1291. The relative magnitude of these two balance restoring effect will depend on the spring constants and degree of precompression, if any, and on the size and shape of the vent grooves and the like. The spring could be omitted altogether, in which case the construction would be like that of the amplifier of FIG. 26.

It is to be noted that the venting of the lines 1261, 1263, by the feedback grooves 1289, 1291 is in parallel with the venting effected by the transmitter. Fluid passing from lines 1261, 1263 going through the restrictions of transmitter needle 1239 to the passage 1257 for return to the reservoir does not pass through the restrictions of feedback grooves 1289, 1291. This parallel arrangement is advantageous over systems such as shown in U.S. Pat. No. 2,709,421 to Avery wherein the amplifier feedback is in series with the transmitter. In the series arrangement, the effect of the feedback depends on the amplitude of the transmitter input. Like light bulbs in series, if one is out, the whole string is out. With the parallel arrangement herein disclosed, an additional transmitter 1201A may be provided in parallel with the transmitter 1202 across lines 1261, 1263, enabling the system to be controlled from either of two spaced apart stations whereat are located the respective transmitter. As many paralleled transmitters can be employed as desired.

The piston 1207 of amplifier 1302 has two loads 1307, 1308 which, as in a spool valve, control flow pressure fluid from duct 1205 to ducts 1313, 1315 leading to the swash plate 1205 constituting the load. At this point the system differs somewhat from the system of FIGS. 2 and 26 in that the output lines from the amplifer do not go to opposite sides of one load piston of a simple piston and cylinder means but instead go to two cylinders 1317, 1318 in which travel pistons 1319, 1320. However, pistons 1319, 1320 are interconnected by piston rods 1321, 1323 pivotally connected to the pistons and to flat circular disc or swash plats 1207. The swash plats 1207 is pivotally mounted at diametrically opposite points, e.g. as at 1322, in a fixed supporting frame or trunnion cradle 1324. The load in the system therefore includes a compound piston and cylinder means wherein the action of the two pistons 1319 and 1320 is not independent, the pistons being linked together via the swash plate.

Absent any pressure differential between lines 1313 and 1315, the Helical centering springs 1328, 1330 disposed in cylinders 1317, 1318 position the swash plate with its face plane 1332 perpendicular to the axis of shaft 1334. The springs each bear at one end against one of the pistons and at the other end against a washer or ring 1336, 1338 which in turn are adapted to bear against shoulders 1341, 1342 in the cylinder walls. The springs may be under a certain amount of precompression effected by screws 1344, 1346 which are screwed into the pistons and whose heads engage the washers. The cylinders are provided with extensions 1348, 1350 into which the screws can extend when the associated spring is compressed, as shown in the case of spring 1328. On the other hand, if the swash plate displacement exceeds the precompressed length of the spring, the associated screw and washer keep the spring in contact with the piston as shown in the case of spring 1330.

The motor/pump unit 1209 includes the aforementioned shaft 1334 mounted for rotation in bearins 1360, 1362. A cylinder block 1364 is keyed to shaft 1334. A plurality of pistons 1366, e.g. two, four, six, or eight or even an odd number such as one or three are mounted each in one of plural bores 1368 in the cylinder block. Piston rods 1370 connect the piston 1366 with pivoted shoes or cam followers 1372 bearing against the face of 1332 of the swash plate or end cam 1207. As the rotating shaft 1334 turns the cylinder block, the pistons 1366 are moved in and out and function as a pump with respect to fluid in lines 1390, 1392. For example fluid would be drawn in through line 1390 and expelled through line 1392 via valve plates 1392, 1394. Ported valve plate 1394 is stationary and connected to lines 1390, 1392. Valve plate 1396 is affixed to the cylinder block and rotates with it. The ports in rotating plate 1396 communicating with the several cylinder 1368 are at appropriate times in register with the appropriate ones of the ports in the stationary valve plate 1394 that communicates with the respective lines 1390, 1392 so as to effect the desired pumping action. By pumping fluid in at 1392 and out at 1390, the device becomes a motor. Whether operating as a motor or a pump, adjustment of the swash plate angle varies the volume of piston displacement. In addition to the feedback from the amplifier, load feedback 1211 is provided. The feedback valve 1211 is the same as that shown at 642 in FIG. 26, but it is driven by swash plate 1207 to which it is pivotally connected at 1398. The load feedback 1211 is in parallel with the amplifier feedback. As feedback needle 1400, which is double tapered or else provided with multiple tapered grooves, is moved axially by the swash plate, the degree of restriction at ports 1404, 1406 between port 1402 that goes in the fluid reservoir and ports 1408, 1410 that go to the transmitter output lines 1201, 1203, is varied in a direction to negate pressure changes caused by the transmitter, the same as in the case of the amplifier feedback, thereby to bring the swash plate to rest. Absent the load feedback, the swash plate would be balanced only by the action of the springs 1328, 1330, even with the amplifier balanced by its own feedback, but with the additional load feedback reliance upon the springs is not necessary.

A previously known swash plate control similar to that above described but using mechanical or electrical feedback is disclosed in catalog 625 believed to have been published about 1973 by MOOG Inc. Controls Division, Pioneer Airport, East Aurora, N.Y., entitled MOOG Electric Controller For Sundstrand Hydrostatic Drives; see especially pages 7–10 See also U.S. Pat. No. 3,065,735—Charles Jr. et al and U.S. Pat. No. 3,228,423 to Moog, Jr. However, the Moog catalog is not believed to teach rebalancing of the amplifier and load by negative feedback of fluid pressure as herein disclosed, and such fluid feedback is believed to be advantageous e.g. in allowing greater distance between load or amplifier and transmitter, than is feasible mechanically, and in being more reliable than electrical feedback, especially in certain environments.

Optionally, indication of the position of the swash plate may be provided by driving an indicator 1420, e.g. from the load feedback valve needle. As shown, a rod 1422 connected to the valve needle moves core 1424 relative to the coils 1426 of a linear voltage differential transformer (LDVT) to produce a voltage proportional to displacement. The voltage can drive a galvanometer to indicate swash plate position.

Figure 41:
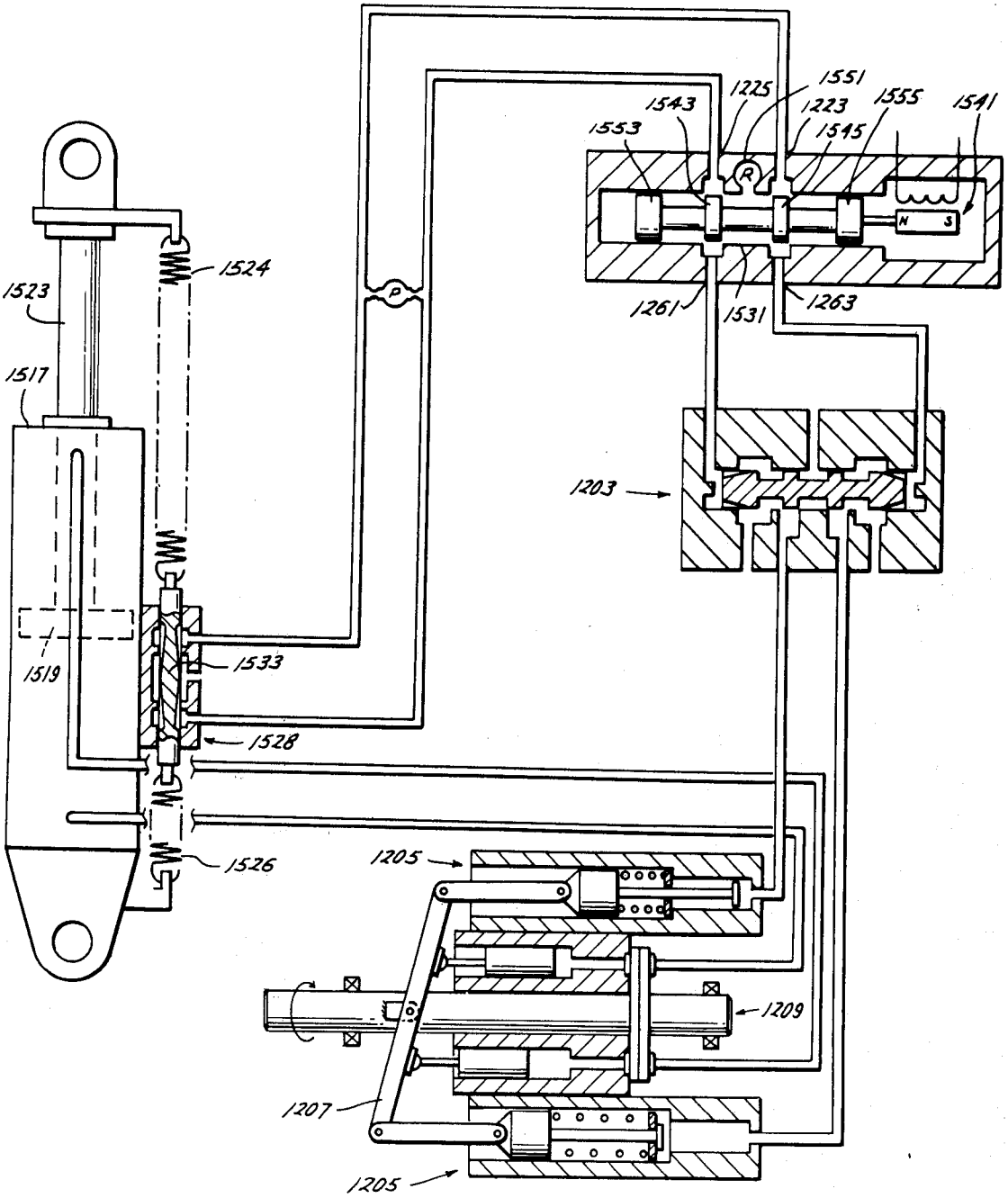
FIG. 41 is a view similar to FIG. 4 showing a modification.

A modified form of swash plate angle control system is shown in FIG. 41. The system is similar to that of FIG. 40 except for the transmitter and load feedback, and ports the same as in FIG. 40 are given like numbers.

Instead of using manual actuation for the swash plate angle control system as shown in FIG. 40, an electric actuator is used in FIG. 41. Such actuator is the same functionally as that shown in FIG. 1, in view of which like parts on given the same numbers plus 1500, and further description rendered unnecessary. The connecting fluid passages are given the same numbers as in FIG. 40. It is to be observed in comparing the various embodiments, that in same cases, e.g. as in FIG. 40 and 41, the fluid passages, e.g. from the pump, feed not only one devise, e.g. the transmitter, but also feed another device, e.g. the amplifier, by using enlarged annular passages in the valve block, e.g. of the transmitter, as manifolds for transmitting fluid around the transmitter the amplifier instead of having separate lines for transmitter and amplifier as in FIG. 1, but there are all functionally equivalent.

In the embodiment of FIG. 41, the swash plate controlled motor/pump unit is connected to a load cylinder 1417 similar to cylinder 17 of FIG. 1 and to cylinder 632 of FIG. 26. If desired, the cylinder could be exactly like that shown in FIG. 26 in that the cylinder could be connected to a cam actuated feedback valve like feedback 643. Instead, however, the load piston rod 1523 is connected by swivel 1524 to tension spring 1524. Spring 1524 is connected to the core or needle 1533 of feedback valve 1528. The other end of needle 1533 is connected to lines of spring 1526, which is shorter than spring 1524. The other end of spring 1526 is connected to cylinder 1517. By this arrangement the travel of needle 1533 is proportional to but less than that of piston 1523. Except for the manner in which it is driven, feedback valve 1528 is the same as feedback valve 643 of FIG. 26.

In the system of FIG. 41, the swash plate motor/-pump unit functions as a variable hydraulic amplifier or servo motor controlling load piston 1519 in load cylinder 1517. The swivel connection between the load feedback valve 1528 and load piston rod 1523 allows whatever is connected to rod 1523 to rotate about the rod axis without interference from the load feedback.

Although two servo motor means 1205 are shown, in the preferred embodiments, for moving the swash plate, it is to be understood that a single servo motor means could be employed, eg. the device 117 of FIG. 1 could be connected to the swash plate via piston rod 123.

Figure 42:
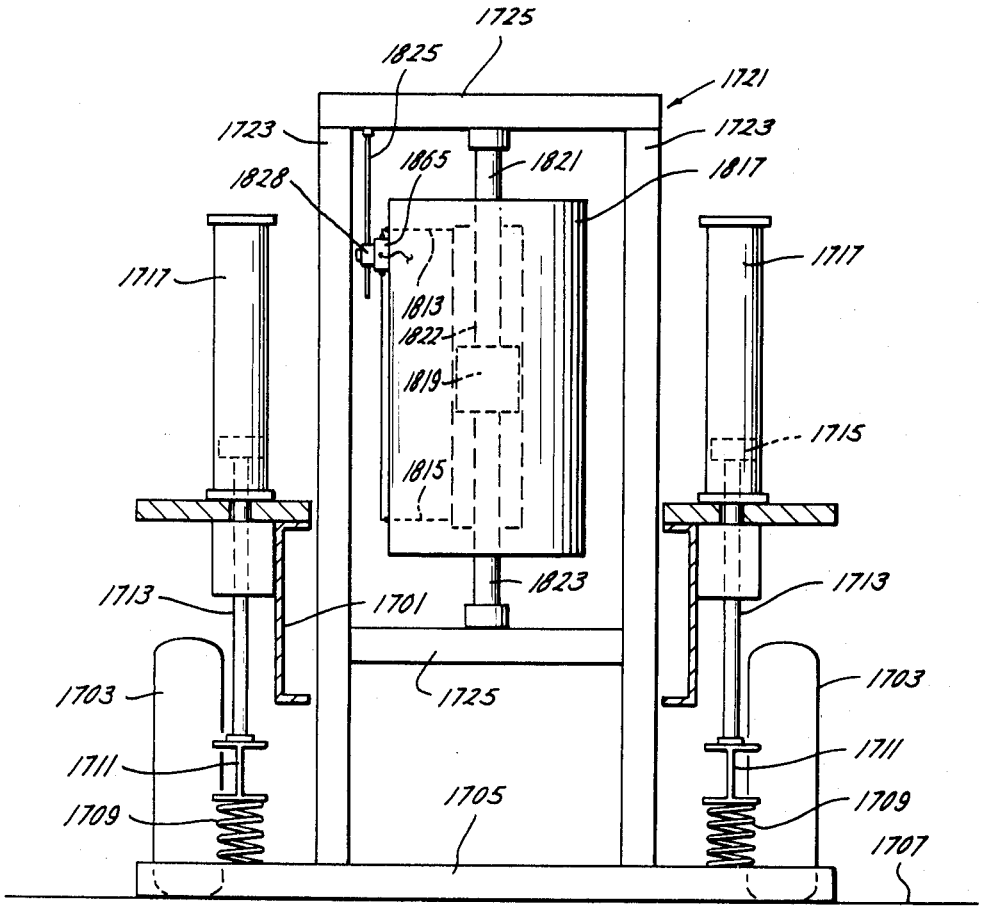
FIG. 42 is an elevation, partly in section, showing apparatus incorporating the invention forming part of a seismic generator.

Referring now to FIG. 42 there is shown an application of the invention to the drive mechanism for a seismic generator of the type known to the trade under the trade-mark Vibroseis. For disclosure of the details of method and apparatus employed in the Vibroseis system see U.S. Patents number:

| | | |
|---|---|---|
| | System | |
| | 2680124 | Doty et al |
| | Trucks | |
| | 3024861 | Clynch |
| | 3306391 | Bays |
| c.f. | 3306392 | Kilmer |
| | Couplers | |
| | 3143181 | Bays |
| | 3159232 | Fair |
| | 3159233 | Clynch et al |
| | 3205971 | Clynch |
| | 3329930 | Cole et al |
| | 3286783 | Cherry et al |
| | 3291249 | Bays |
| | 3365019 | Bays |
| | Vibrators | |
| | 3059483 | Clynch |
| | 3282372 | Brown |
| | 3372770 | Clynch |
| | Servo System | |
| | 3361949 | Brown |

Referring to FIG. 42 there is shown the rear portion of an automobile or truck having a chassis or body frame 1701 and rear wheels 1703 which are connected to the truck frame by conventional means not shown. A ground engaging plate 1705 is resiliently pressed against the earth's surface 1707 by coil springs 1709 which react against I-beams 1711 carried from the truck frame by piston rods 1713. The piston tods are connected to pistons 1715 which move in compressed air cylinders 1717. By means of the piston and cylinder means 1715–1717, the truck chassis can be jacked up to place any desired amount of the truck weight on the springs 1709, or the plate 1705 can be elevated off the ground 1707 to enable the truck to move to a new location.

Connected to plate 1705 is a rigid framework 1721 including vertical posts 1723 and horizontal struts 1725. The struts are connected to the ends 1821, 1823 of a load piston rod 1822 like the ends 21, 23 of the load piston rod of FIG. 1. The piston rod 1822 carries a piston 1819 affixed thereto which moves in load cylinder 1817. The load cylinder is connected by hydraulic lines 1813, 1815 to cylinder 1865 of an amplifier which is the same as the amplifier including cylinder 65 of FIG. 1. A transmitter, not shown, like the transmitter of FIG. 1, applies pressure differentials to the amplifier in response to an electrical input like input 111 of FIG. 1. By applying an oscillating electrical input to the transmitter actuator, the amplifier and load piston respond to cause struts 1725 to move up and down. Cylinder 1817 is unattached to the truck frame, being supported only by air pressure in the cylinder at the opposite sides of piston 1818. The cylinder is sufficiently massive that a desired amount of movement of piston 1819 and plate 1705 is created by the variation of pressure differential in the cylinder on opposite sides of the piston.

The amplifier cylinder 1805 is affixed to the load cylinder 1817. A load feedback means or unit 1828 like load feedback means or unit 128 of FIG. 1 is affixed to the amplifier and is driven by a load feedback rod 1825 like rod 125 of the FIG. 1 embodiment. The feedback stabilizes the operation of the servo amplifier, controlling the load oscillations to be proportional to at least some degree to the amplitude of the electrical oscillations fed to the transmitter input.

Heretofore, Vibroseis units have been driven with electro-hydraulic systems similar to that shown in the aforementioned MOOG catalogue. The present improvement relates to the utilization of the FIG. 1 system in conjunction with a Vibroseis seismic generator.

Figure 43:
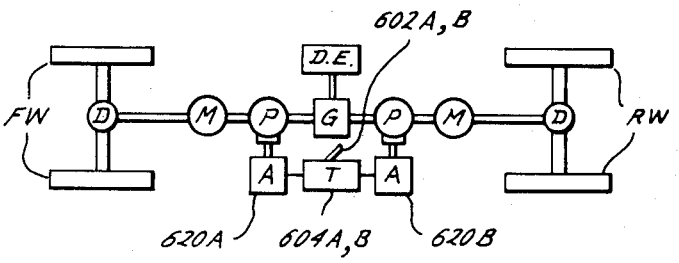
FIG. 43 is a schematic plan view of apparatus according to the invention employed for steering a four wheel drive vehicle.
Figure 44:
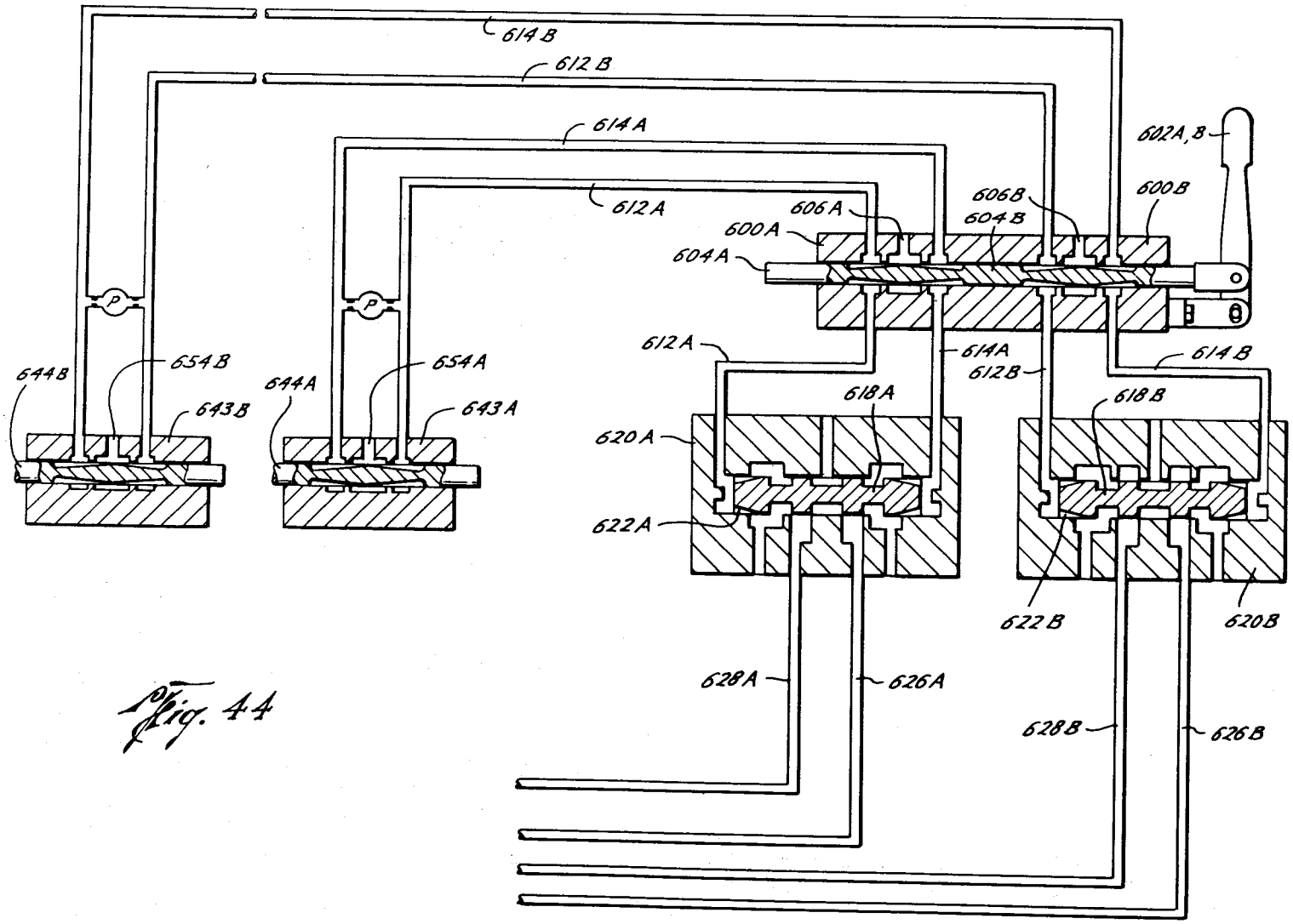
FIG. 44 is a largely sectional view of apparatus according to the in-ention suitable for dual parallel, control, e.g. as in FIG. 43.

Referring now to FIGS. 43 and 44 there is shown another modification of the apparatus shown in FIG. 1 suitable for simultaneous control of two servo systems. Such an arrangement is useful in four wheel drive trucks, for example, as shown in FIG. 43. A diesel engine D.E. may drive a gear box G which in turn drives two hydraulic pumps P which in turn drive hydraulic motors M. One motor may drive the two front wheels FW and the other the two rear wheels RW, in each case through a differential D. The pumps may be of the swash plate type shown in FIG. 40 and 41, with variable angle swash plates, the angle of the swash plate of each pump being controlled by a separate amplifier A, the two amplifiers being controlled by the two outputs of one dual transmitter T.

Referring now more particularly to FIG. 44, the dual transmitter comprises two transmitter valves having a common valve core and valve cylinder with a single actuating means and is otherwise the same as the constructions previously described, e.g. as described in connection with FIG. 26. Therefore the same reference numbers are used as in FIG. 26 with the addition of A or B for the two system. Based on the foregoing and remembering that P stands for pump or pressure and that R stands for reservoir or return where marked on the drawing and having references to the usual hydraulic system, it is believed the operation of the system will be clear.

In operation, movement of manual actuator 602AB will shift both transmitter valve cores 604A and 604B to create differential pressures between both pairs of output lines 612A, 614A and 612B, 614B. In turn the two amplifier spools 618A, 618B will be shifted to control their output lines 626A, 628A and 626B, 628B. The loads connected to the two pairs of amplifier output lines will then be shifted, e.g. two sets of swash plates of the type shown in FIG. 40 or two load pistons of the type shown in FIG. 26 at 632. Feedback from the amplifiers is effected by vent grooves at 622A and 622B. Load feedback is effected by each load, e.g. swash plate or piston rod, being connected to one of the load feedback valve cores 644A or 644B, thereby variably venting lines 612A and 614A and lines 612B and 614B in parallel with the amplifier vent grooves.

Since the two transmitters are tied together mechanically, the two servo systems will follow in unison.

Figure 45:
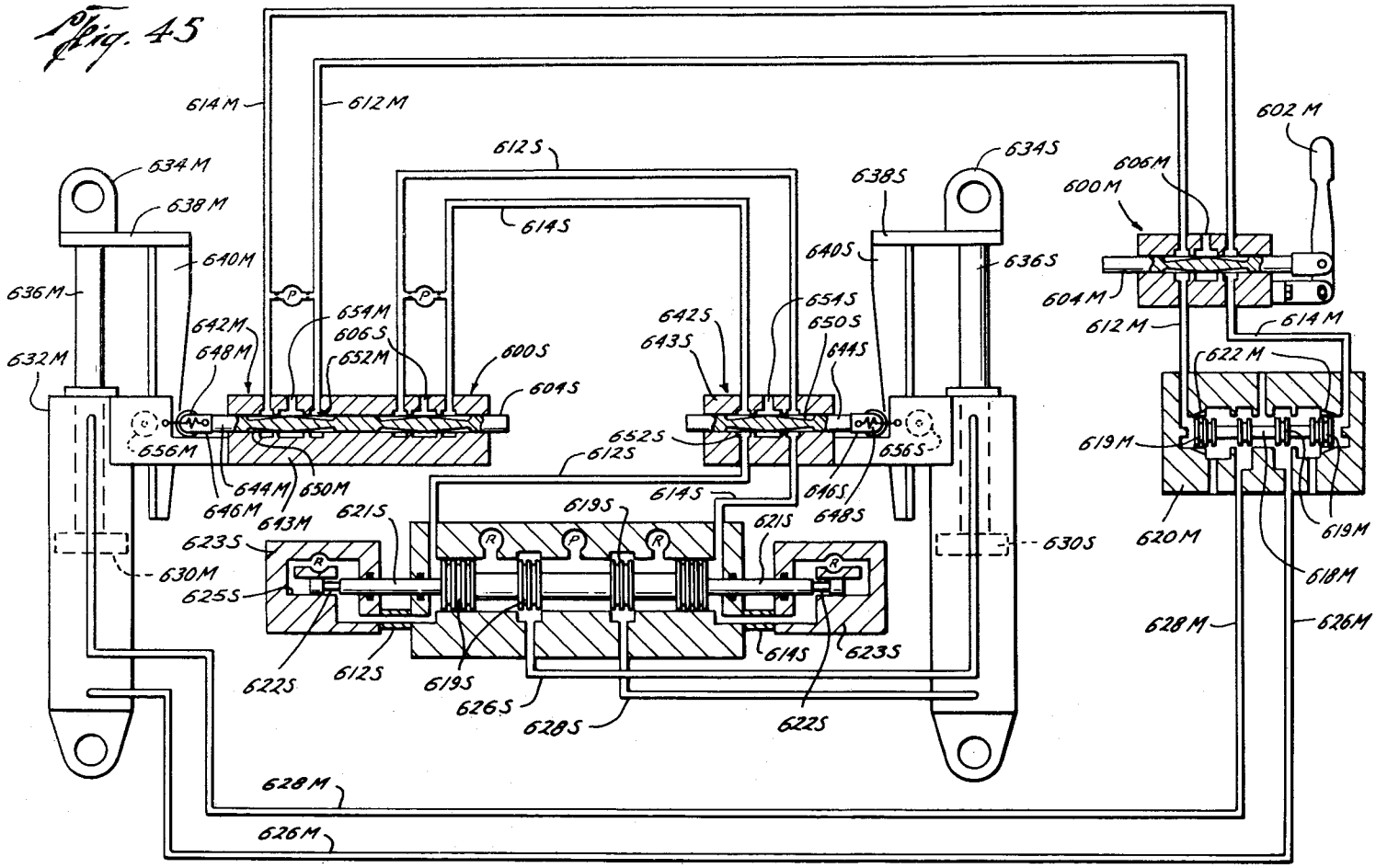
FIG. 45 is a largely sectional view of apparatus according to the invention for dual control of the master and slave type.

Another example of the utility of two servo systems working together is the case of twin rudders on a ship. Also in connection with shipboard use is the case of two or more Davits or booms operating to haul in a long object. In some dual load applications it may be desirable to ensure that one load does not move until the other is out of the way. In such case a master and slave system as shown in FIG. 45 may be employed. In general the servo systems, both master and slave, are like those shown in FIG. 26, so the same reference numbers are used in FIG. 45 except for the addition of M or S to indicate master or slave unit. However, opportunity is taken in FIG. 45 to illustrate two modified forms of amplifier feedback in one of which the feedback grooves are in the cylinder rather than in the piston and in another of which the feedback vent control is external to the amplifier, in either case making it possible to provide pressure equalization grooves around the pistons or lands of the amplifier valve.

In operation, actuator 602M is moved to change the position of the master transmitter 600M. The differential pressure between lines 612M, 612S thus created shifts master amplifier spool valve 618M. The latter is brought to equilibrian by its own master feedback provided by vent grooves 622M and by the master load feedback. The shifted amplifier valve varies the fluid supplied to the master load cylinder 632M causing it to move the load connected at 634M. At the same time the master load feedback 624M driven by cam 640M varies the venting of lines 612M 614M to assist in restoring balance to the amplifier. When the load feedback is sufficient, the amplifier returns to its neutral position and further fluid flow to the load cylinder ceases, the load piston then coming to rest.

Meanwhile, movement of the load piston 630 M, working through cam 640M, also varies the position of slave transmitter 600S whose valve core is an extension of the valve core or needle of the master load feedback 624M.

Motion of the slave transmitter moves the spool of slave amplifier 618S which in turn varies the fluid flow to slave load cylinder 630S. The initial motion of the slave amplifier is proportional to the motion of the slave amplifier due to the slave amplifier feedback provided by external vent valves 622S. When the load has moved a proportional distance, the slave load feedback 642S, driven via cam 640S will have brought the slave amplifier back to neutral by restoring pressure balance between lines 612S and 614S. At this time the slave load piston will stop moving, having shifted a distance equal or proportional to or any other desired function of the movement of the master piston.

Note that both the master and slave amplifier valve spools are provided with annular pressure equalizing, antistick grooves 619M, 619S. Such grooves are previously known, per se, but this use is difficult if the feedback is effected by tapering grooves in the amplifier piston. By putting the feedback grooves in the cylinder as in the master amplifier, or by providing external feedback valves 622S as in the slave amplifier, it seems possible to provide the amplifier spool with the desired pressure equalizing grooves.

Referring to the fedback on the slave amplifier, it may be added that the amplifier spool is provided with extensions 621S which extend through sealed apertures in the ends of the spool valve cylinder and through apertures in feedback valve bodies 623S. The annular grooves 622S on the extensions 621S permit fluid flow to the reservoir from the continuation of lines 612S, 614S in varying amounts depending on their axial position relative to cylinder 625S.

Figures 46, 48:
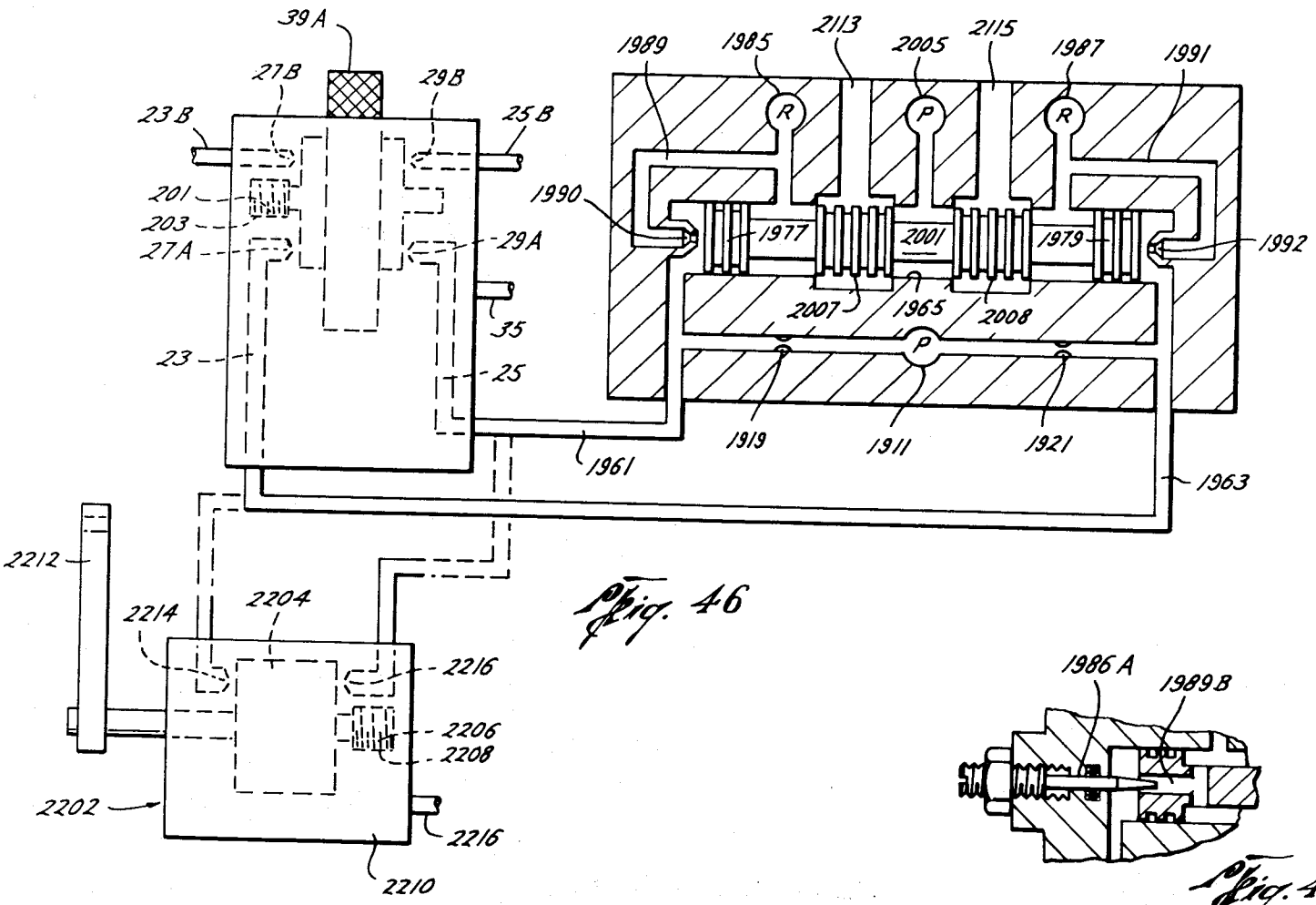
FIG. 46 is a partly sectional view illustrating another form of apparatus according to the invention.
FIG. 48 is a sectional view showing a modification of the amplifier of FIG. 47.

Alternative amplifier feedbacks of the external type which permit grooving of the spool loads for pressure equalization are shown in FIGS. 46, 47, and 48. Basically these amplifiers are the same as those of FIG. 1 and like or analogous parts will be given the same number plus 1900. Instead of vent grooves 89, 91 as in FIG. 1, the FIG. 46 amplifier employs vent passages 1989, 1991 which connect the reservoir passages 1985, 1987 to the ends of the amplifier free piston or spool. Such connection is made via reverse nozzles 1990, 1992 which protrude into the spares at the ends of cylinder 1965. In operation, when the piston or spool 2001 is shifted axially, the ends of the piston approach or recede from the inverse nozzles making flow thereinto easier or more restricted, thereby providing the desired negative feedback.

In the amplifier of FIG. 47 the amplifier is similar to that shown in FIG. 46 except that the inverse nozzles 1990A, 1992A are provided in the piston itself, as are the vent passages 1989A, 1991A. The vent passages include axial portions leading from the nozzles to plural radial passages opening into cylinder 1965. Axially adjustable threaded obstructor pins 1986, 1988 protrude into the ends of cylinder 1965 through O-ring seals. By means of those pins the degree of restriction provided to flow into nozzles 1990A, 1992A can be adjusted. Lock nuts hold the pins in the desired adjusted positions.

FIG. 48 shows a further variation of the amplifier which is similar to the FIG. 47 amplifier except that the nozzles 1990A, 1992A are omitted and the ends of the adjustable obstructor pins, e.g. as shown 1986A, are tapered and extended into the vent passages in the pistons, e.g. the vent passage 1989B. This slows the rate of change of venting versus axial movement of the amplifier piston or spool compared to the arrangements of FIGS. 46 and 47.

Referring once more to FIG. 46, there is also illustrated a dual transmitter. However, instead of the transmitter being of the axially moving type shown in FIG. 44, a transmitter similar to the rotary transmitter of FIGS. 4 and 5 is employed and the same reference numbers are used for the transmitter as in FIGS. 4 and 5. The difference lies in the addition of two extra nozzles 27B, 29B for controlling an additional servo system (not shown) by varying the pressure differential between the additional pair of output lines 23B, 25B.

FIG. 46 also shows a rotary type load feedback means 2202 employing an obstructor body 2204 having a threaded shaft 2206 working in threaded opening 2208 in the feedback housing 2210. The shaft is rotated by lever 2212 connected to the load (not shown) to be turned as the load rotates. Axial travel of obstructor body 2204 caused by its rotation causes it to approach and recede from vent nozzles 2214, 2216, thereby variably to vent passages 1961, 1963 to reservoir return line 2216 and provide the desired system feedback.

Radial Play Neutralization

Figure 7:
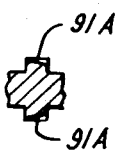
Figure 6:
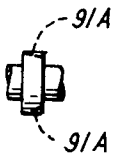

In the previously described systems and apparatus wherein various axially extending feedback grooves were employed in the amplifier spool, such grooves are preferably plural in number and equiazimuthally disposed around each land, as in FIGS. 6–8, or inside each cylinder portion adjacent such land, as in the master amplifier of FIG. 44, in order to neutralize the effect of radial play of the spool within the cylinder. For a like reason, transmitter and feedback venting means, e.g. as in FIG. 26, preferably include plural, equiazimuthally spared grooves on the valve cores. In a rotary transmitter or feedback the desired result of neutralizing the effect of radial play can be obtained by using plural equiazimuthally spaced ports, as illustrated in FIGS. 49, 50, and 51. The construction there shown also illustrates another form of dual transmitter for simultaneous control of two servo systems from a single actuator.

As shown in FIG. 49, an actuating lever 2301 is fastened by a pin 2302 to a shaft 2303. Lock rings 2304, 2305 hold the shaft against axial motion relative to cylinder body 2320 within which the shaft turns. The lock rings bear against washers adjacent the body 2320 which may be undercut to hold felt seals. However, O-rings 2306, 2307 provide the primary seals between the shaft and the cylinder. The shaft includes a pair of cylindrical bearing lands 2308, 2309 and a plurality of partial cylindrical lands 2313, 2314, separated by cylindrical grooves 2310, 2311, 2312. As seen in FIGS. 50 and 51, lands 2313 and 2314 are undercut below full cylindrical diameter on opposite sides of each land, at 2322–5, over an area of approximately 100 degrees on each side. The undercut portions are of variable depth of undercut, tapering from both ends toward the middle.

Fluid passages 2315, 2316, 2317, 2318 in body 2320 each communicate through two braches, as shown in FIGS. 50 and 51 with ports A, $A^1$, B, $B^1$, C, $C^1$, D, $D^1$, at opposite sides of the inner periphery of the cylindrical bore 2321 in body 2320. Another fluid passage 2319 communicates with the interior of bore 2321 adjacent groove 2211 below the undercut lands 2313, 2314. The branching ends of the passages 2315, 2316, 2317, 2318, are thus placed in communication with return to reservoir fluid passage 2319 in varying amounts according to the rotational position of shaft 2303, thereby to create pressure differentials between the pairs of output lines 2315, 2316 and 2317, 2318 of the dual transmitter. Any radial play between shaft 2303 and bore 2321 will be neutralized since flow through one branch of each of lines 2315, 2316, 2317, 2318 will be increased thereby and the other decreased.

It will be understood that the pairs of transmitter lines 2315, 2316, and 2317, 2318, will be connected to a source of fluid pressure having a drooping pressure versus fluid flow rate characteristic the same as in FIG. 1 (pump 11, restrictors 19, 21) so that variation of the restriction to flow dependent on the positions of undercut areas 2322-5 on the otherwise cylindrical lands 2308, 2313, 2314, 2309, will effect the desired change in pressure differential between the output lines of the transmitter. The undercut areas on the lands 2313, 2311 are arranged so that after only a slight rotational movement from the neutral position shown, some of the ports A–D. $A^1$–$D^1$ will be blocked completely so that the pressure differential variation caused by further rotation will be due solely to gradual enlargement of the pathways to the other ports. This is believed to work best. However, if desired, the undercut areas could be arranged so that the closure of the ports would be gradual at the same time the other ports are gradually opened.

From the foregoing description it will be apparent that a typical embodiment of the invention includes a transmitter, amplifier, and a load piston and cylinder means, with feedback means actuated by both the amplifier and by the load piston and cylinder. Sometimes the load piston and cylinder have been called a receiver, reflecting the fact that the system can be used for remote control. Depending on its position as being adjacent the transmitter or adjacent the load piston and cylinder means, the amplifier may be said to be part of the transmitter or receiver, using these terms in a broader sense. Since the element referred to as an amplifier can in some cases be replaced by a similarly functioning device which does not amplify, it has sometimes been called merely a responder. This also reflects the fact that the responder can be used directly as an indicator or load actuator rather than as a valve to control a load piston and cylinder means or servo motor. Sometimes the word responder is used more broadly to refer to all of that which follows the transmitter, in which case the amplifier or first stage following the transmitter may be called a primary piston and cylinder means and the second stage a secondary or load piston and cylinder means.

The variable pressure line or lines from the transmitter may be called its output, in that the transmitter produces a variable pressure signal that is sent out to the next stage of the system. In like manner, the fluid flow lines controlled by the valve that constitutes the amplifier or responder may be called the output of the amplifier or responder.

The foregoing explanation of the terminology used in the description and the claims will help correlate the claim language with that of the description of the preferred embodiments.

While preferred embodiments of the invention have been shown and described, many modifications thereof can be made by one skilled in the art without departing from the spirit of the invention.

That being claimed is:

1. Fluidic repeater comprising:

a transmitter, a responder, a single line for transmitting pressure signals between said transmitter and responder, and fluid supply means including a source of pressure fluid for causing a pressure fluid to flow through said line, said transmitter including a variable flow obstructor connected in the aforementioned pressure signal transmitting line between one end thereof and said responder to create a variable pressure difference upstream and downstream of the obstructor and thereby vary the pressure in the portion of said line between said obstructor and said responder, said transmitter further including operator means connected to the flow obstructor for changing the position of the obstructor between a first position partly blocking said fluid flow and a second position blocking said fluid flow to a lesser extent and a continuous range of intermediate positions of differing degrees of blocking said fluid flow between the blocking in said first and second positions and maintaining the obstructor in any desired one of said first, second and all intermediate positions, said responder including a cylinder having a piston movable axially therein, said cylinder having a peripheral surface and said piston having a periphery adapted to slide axially within said peripheral surface over a range of axial motion, said piston having two transverse portions athwart the axis of the piston adapted to receive fluid pressure, said cylinder having two transverse portions athwart the axis of the cylinder, said transverse portions of the cylinder being farther apart than said transverse portions of the piston leaving spaces between the transverse portions at each end of said periphery of the piston and the transverse portions at the corresponding end of said peripheral surface of the cylinder when said piston is positioned between the ends of said range of axial motion, the aforementioned pressure signal transmitting line connecting at its other end to the responder cylinder to communicate with one of said spaces, opposition means communicating with the other of said spaces creating an opposing force thereon independent of the position of the transmitter operating means, and feedback means including a flow passage communicating with the other of said spaces to vary the pressure therein by connecting the last said space to reservoir of fluid at lower pressure than said line without passing through said pressure signal transmitting line, a variable flow restrictor in said flow passage, and means connecting said variable flow restrictor to said responder to cause displacement of said flow restrictor in an amount dependent upon the amount of displacement of said responder piston and independent of the rate of said piston's displacement and of the length of time said piston's displacement persists, said cylinder including an aperture in one of said transverse portions thereof, said piston having a piston rod extending through said aperture adapted for connection to a load, said feedback means functioning to bring said piston to rest in different positions over a continuous range of positions corresponding to said continuous range of positions of said operator means of said transmitter to thereby place said piston rod and any load attached thereto in any desired position over a continuous range of positions, said single line extending from said one of said spaces through said obstructor to said reservoir of fluid at lower pressure than said line, said fluid supply means comprising a branch line having a second flow restrictor therein extending from said single line between said one of said spaces and said obstructor through said second flow restrictor to said source of pressure fluid, whereby fluid from said source can flow through said second flow restrictor and branch line to said single line and thence through a portion of said single line and said variable flow obstructor of the transmitter to said reservoir, by-passing said one of said spaces.

2. Fluidic repeater according to claim 1, said cylinder including a cylindrical aperture in the other of said transverse portions thereof, said piston having a cylindrical valve rod extending through said cylindrical aperture, said valve rod having a paraxial groove in its outer periphery of gradually increasing depth in the direction toward the distal end of the valve rod, said cylindrical aperture forming a part of said flow passage of said feedback means and the grooved valve rod providing said variable flow restrictor therein.

* * * * *

UNITED STATES PATENT AND TRADEMARK OFFICE

CERTIFICATE OF CORRECTION

PATENT NO. : 4,283,990

DATED : 8-18-81

INVENTOR(S) : Willie Burt Leonard

It is certified that error appears in the above—identified patent and that said Letters Patent is hereby corrected as shown below:

Column 1, line 21: change "amplication" to -amplification-.

Column 2, line 2: change "referred" to -preferred".

Column 2, line 19: delete "and".

Column 2, line 53: change "largley" to -largely-.

Column 3, line 10: change "4" to -40-.

Column 3, line 19: change "in-ention" to -invention-.

Column 3, line 26: after "sectional" insert -view-.

Column 3, line 62: change "moves" to -move-.

Column 4, line 9: change "this" to -thus-.

Column 4, line 26: after "63 to" insert -a responder which in this case is-.

Column 4, line 43: change "cylinder'" to -cylinder's-.

UNITED STATES PATENT AND TRADEMARK OFFICE

CERTIFICATE OF CORRECTION

PATENT NO. : 4,283,990

DATED : 8-18-81

INVENTOR(S) : Willie Burt Leonard

It is certified that error appears in the above—identified patent and that said Letters Patent is hereby corrected as shown below:

Column 4, line 53: change "these" to -the-.

Column 4, line 55: change "33" to -63-.

Column 4, line 63: change "Cylinder" to -The responder comprising cylinder-.

Column 5, line 11: before "ports" insert -output-.

Column 5, line 11: change "107" to -110-.

Column 5, line 12: before "fluid" insert -of the-.

Column 5, line 12: change "conduit" to -conduits-.

Column 5, line 60: after "151" insert -,153-.

Column 5, line 68: delete "cylinder" and insert -feedback valve-.

Column 6, line 24: change "2;" to -2-.

Column 6, line 24: change "FIGS." to -FIG.-.

Column 6, line 25: delete "and 17".

Column 6, line 28: change "FIGS. 2 and 3" to -FIG. 3-.

Column 6, line 28: delete "in FIG. 2 as" and insert -whereas-.

UNITED STATES PATENT AND TRADEMARK OFFICE

CERTIFICATE OF CORRECTION

PATENT NO. : 4,283,990

DATED : 8-18-81

INVENTOR(S) : Willie Burt Leonard

It is certified that error appears in the above—identified patent and that said Letters Patent is hereby corrected as shown below:

Column 6, line 30: delete "whereas".

Column 6, line 33: delete the sentence "In other...the same."

Column 6, line 35: after "two" insert -additional-.

Column 6, line 43: delete "valve stems" and insert -piston rods-.

Column 8, line 4: after "amplifier" insert -responder-.

Column 8, line 18: before "end" insert -one-.

Column 8, line 28: after "239" insert -are-.

Column 8, line 30: before "normally" insert -which-.

Column 8, line 64: delete "receiver" and insert -responder-.

Column 9, line 11: delete "receiver" and insert -responder-.

Column 9, line 22: delete "receiver and insert -responder-.

Column 9, line 57: change "affect" to -effect-.

UNITED STATES PATENT AND TRADEMARK OFFICE

CERTIFICATE OF CORRECTION

PATENT NO. : 4,283,990

DATED : 8-18-81

INVENTOR(S) : Willie Burt Leonard

It is certified that error appears in the above—identified patent and that said Letters Patent is hereby corrected as shown below:

Column 9, line 62: change "FIG.2" to -FIGs. 1 and 2 respectively-.

Column 9, line 68: change "FIGs. 2 and 3." to -FIG. 3-.

Column 10, line 19: change "105" to -119-.

Column 10, line 26: change "pistons" to -piston's-.

Column 10, line 47: change "loan" to -load-.

Column 11, line 3: after "fluid" insert -passage-.

Column 11, line 16: change "321" to -323-.

Column 11, line 17: after "load" insert -piston-.

Column 11, line 17: change "323" to -321-.

Column 11, line 18: delete "required".

Column 11, line 23: change "Oring" to -O-ring-.

Column 11, line 49: delete "receiver" and insert -responder-.

Column 11, line 52: change "351: to -251-; and change "286" to -296-.

UNITED STATES PATENT AND TRADEMARK OFFICE

CERTIFICATE OF CORRECTION

PATENT NO. : 4,283,990

DATED : 8-18-81

INVENTOR(S) : Willie Burt Leonard

It is certified that error appears in the above—identified patent and that said Letters Patent is hereby corrected as shown below:

Column 12, line 15: delete "receiver" and insert -responder-.

Column 12, line 17: after "However," insert -the responder in this case is-.

Column 12, line 17: after "amplifier" insert -and-.

Column 12, line 18: after "invention" insert -the same-.

Column 12, line 23: change "right or left" to -left or right-.

Column 12, line 36: change "31" to -21-.

Column 12, line 45: delete "63" and insert -65 in-.

Column 12, line 46: delete "its" and insert -spool's-.

Column 12, line 64: change "263" to -203-.

Column 16, line 38: change "6-ring" to -O-ring-.

Column 17, line 22: change "809811" to -809, 811-.

Column 19, line 35: change "spring" to -springs-.

UNITED STATES PATENT AND TRADEMARK OFFICE

CERTIFICATE OF CORRECTION

PATENT NO. : 4,283,990

DATED : 8-18-81

INVENTOR(S) : Willie Burt Leonard

It is certified that error appears in the above—identified patent and that said Letters Patent is hereby corrected as shown below:

Column 22, line 3: change "devise" to -device-.

Column 26, line 28: change "spared" to -spaced-.

Signed and Sealed this

*Twelfth* Day of *July 1983*

[SEAL]

*Attest:*

GERALD J. MOSSINGHOFF

*Attesting Officer*

*Commissioner of Patents and Trademarks*